US007951313B2

(12) United States Patent
Matsubayashi et al.

(10) Patent No.: US 7,951,313 B2
(45) Date of Patent: May 31, 2011

(54) SPINNING APPARATUS, AND APPARATUS AND PROCESS FOR MANUFACTURING NONWOVEN FABRIC

(75) Inventors: Yasuko Matsubayashi, Koga (JP); Masahiro Amagasa, Koga (JP); Yukio Kojima, Oyama (JP); Syuichi Murata, Koga (JP)

(73) Assignee: Japan Vilene Company, Ltd. (JP)

( * ) Notice: Subject to any disclaimer, the term of this patent is extended or adjusted under 35 U.S.C. 154(b) by 129 days.

(21) Appl. No.: 12/473,019

(22) Filed: May 27, 2009

(65) Prior Publication Data

US 2009/0295014 A1 Dec. 3, 2009

(30) Foreign Application Priority Data

May 28, 2008 (JP) ..... 2008-139948
Jun. 12, 2008 (JP) ..... 2008-154679
Aug. 7, 2008 (JP) ..... 2008-204830

(51) Int. Cl.
*D01D 5/08* (2006.01)

(52) U.S. Cl. ..... 264/6; 264/555; 425/7; 425/72.2

(58) Field of Classification Search ..... None
See application file for complete search history.

(56) References Cited

U.S. PATENT DOCUMENTS 3,954,361 A 5/1976 Page
4,168,138 A 9/1979 McNally
5,476,616 A 12/1995 Schwarz
5,902,540 A * 5/1999 Kwok ..... 264/555
6,520,425 B1 2/2003 Reneker
7,628,941 B2 * 12/2009 Krause et al. ..... 264/12
2004/0157522 A1 * 8/2004 Bansal et al. ..... 442/327

FOREIGN PATENT DOCUMENTS

WO 99/34039 A1 7/1999
WO 03/062510 A1 7/2003

OTHER PUBLICATIONS

Extended European Search Report for EP Application No. 09161392.7-2109.

* cited by examiner

*Primary Examiner* — Mary Lynn F Theisen

(74) *Attorney, Agent, or Firm* — Heslin Rothenberg Farley & Mesiti P.C.

(57) ABSTRACT

A spinning apparatus comprising one or more exits for extruding liquid, and an exit for ejecting gas, located upstream of the exits for extruding liquid, wherein the apparatus comprises a columnar hollow for liquid, in which the exit for extruding liquid forms one end of the columnar hollow; the apparatus comprises a columnar hollow for gas having the exit for ejecting gas; a virtual column for liquid, extended from the columnar hollow for liquid, is adjacent to a virtual column for gas, extended from the columnar hollow for gas; the central axis of the columnar hollow for liquid is parallel to the central axis of the columnar hollow for gas; and there exists only one straight line having the shortest distance between an outer boundary of the cross-section of the columnar hollow for gas and an outer boundary of the cross-section of the columnar hollow for liquid, is disclosed.

12 Claims, 5 Drawing Sheets

Figure 1
(a)
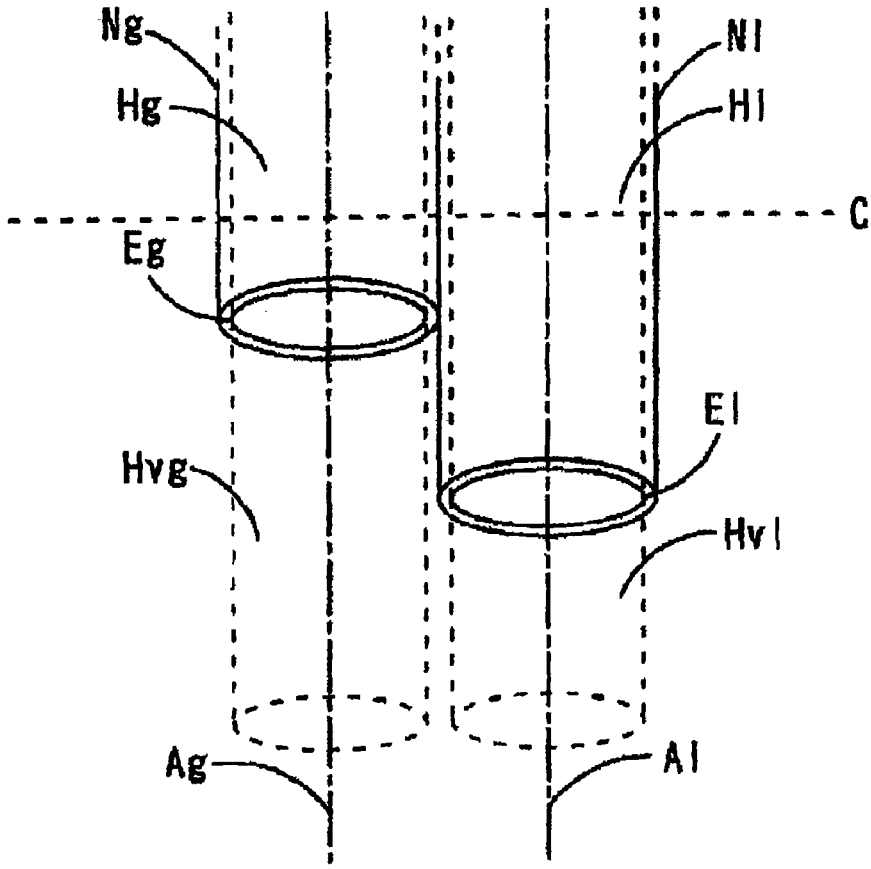
(b)
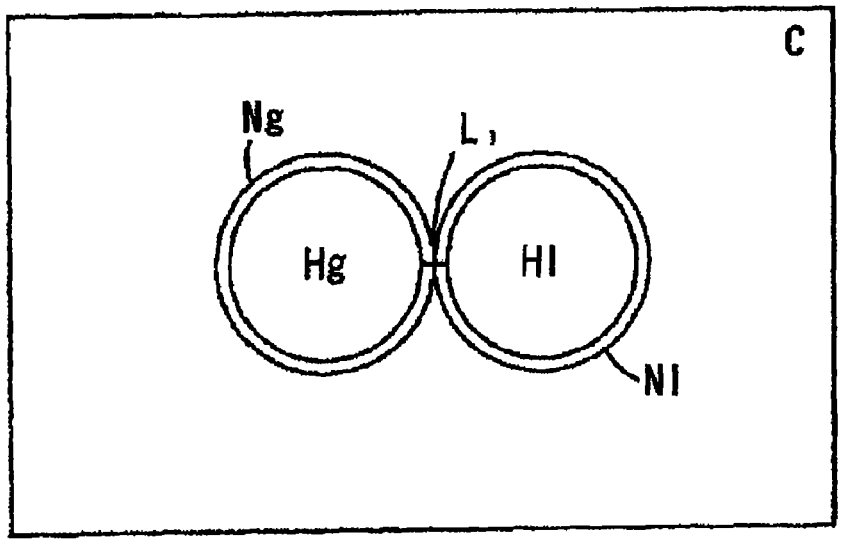

Figure 2 - Prior Art
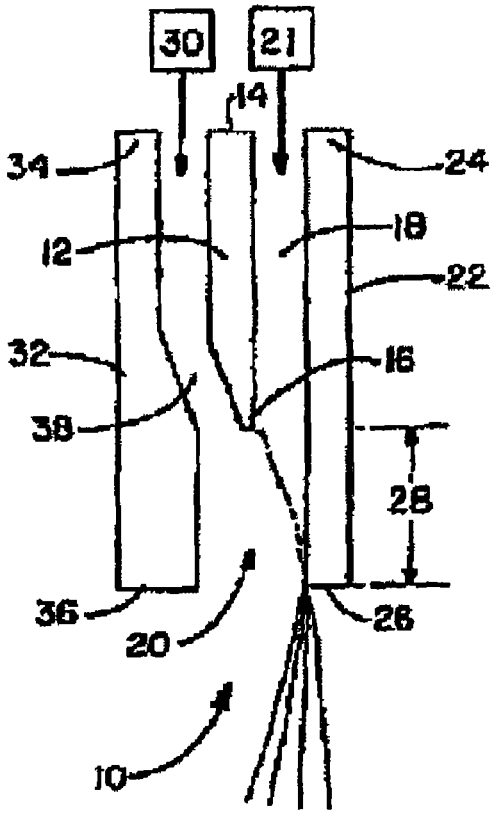
Figure 3 - Prior Art
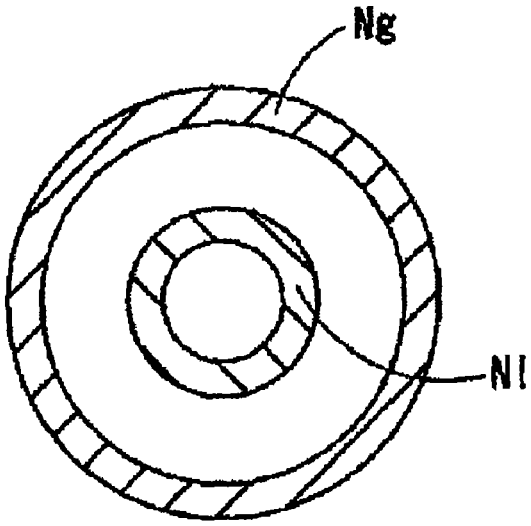

Figure 6
(a)
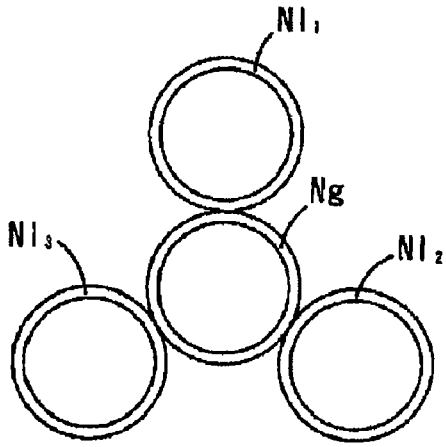
(b)
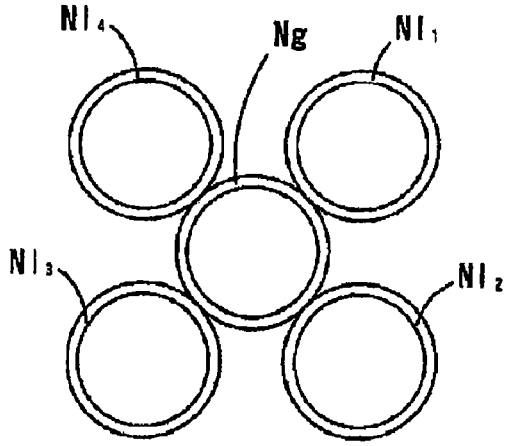
(c)
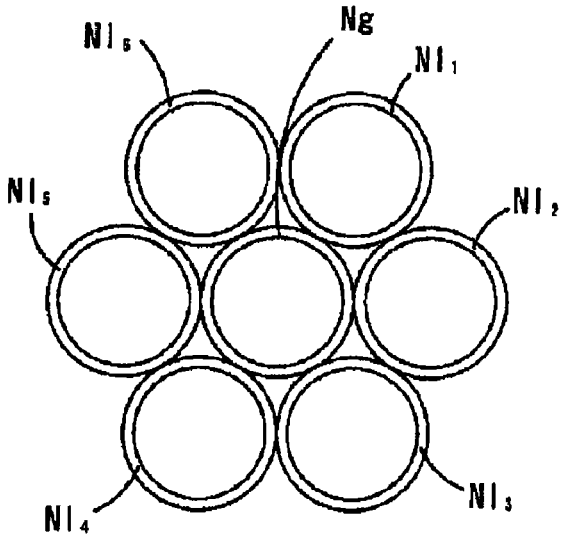

SPINNING APPARATUS, AND APPARATUS AND PROCESS FOR MANUFACTURING NONWOVEN FABRIC

CROSS REFERENCE TO RELATED APPLICATIONS

This application claims priority to Japanese Patent Application Numbers: 2008-139948, filed May 28, 2008; 2008-154679, filed Jun. 12, 2008; and 2008-204830, filed Aug. 7, 2007. The entire contents of each of the prior applications are incorporated herein by reference.

TECHNICAL FIELD

The present invention relates to a spinning apparatus, an apparatus comprising the same for manufacturing a nonwoven fabric, and a process for manufacturing a nonwoven fabric using the nonwoven fabric manufacturing apparatus.

BACKGROUND ART

Fibers having a small fiber diameter can impart various excellent properties, such as a separating property, a liquid-holding capacity, a wiping property, a shading property, an insulating property, or flexibility, to a nonwoven fabric, and therefore, it is preferable that fibers which form a nonwoven fabric have a small fiber diameter. As a process for manufacturing such fibers having a small fiber diameter, electrospinning is known. In this process, a spinning liquid is extruded from a nozzle, and at the same time, an electrical field is applied to the extruded spinning liquid to thereby draw the spinning liquid and thin the diameter of the spinning liquid, and fibers are directly collected on a fibers collection means to form a nonwoven fabric. According to the electrospinning, a nonwoven fabric consisting of fibers having an average fiber diameter of 1 μm or less can be produced. It is necessary in the electrospinning that a high voltage should be applied to the nozzle or the fibers collection means, to apply an electrical field to the spinning liquid, and therefore, a complicated apparatus is needed and the electrospinning wastes energy.

To solve these problems, patent literature 1 proposes "an apparatus for forming a non-woven mat of nanofibers by using a pressurized gas stream includes parallel, spaced apart first (12), second (22), and third (32) members, each having a supply end (14, 24, 34) and an opposing exit end (16, 26, 36). The second member (22) is adjacent to the first member (12). The exit end (26) of the second member (22) extends beyond the exit end (16) of the first member (12). The first (12) and second (22) members define a first supply slit (18). The third member (32) is located adjacent to the first member (12) on the opposite side of the first member (12) from the second member (22). The first (12) and third (32) members define a first gas slit (38), and the exit ends (16, 26, 36) of the first (12), second (22) and third (32) members define a gas jet space (20). A method for forming a nonwoven mat of nanofibers by using a pressurized gas stream is also included.", as shown in FIG. 2. This apparatus does not require the application of a high voltage, and therefore, can solve the problems. However, because flat-shaped first, second, and third members are arranged parallel to each other in the apparatus, and the pressurized gas stream is applied to a sheet-like spinning liquid, it is considered that the spinning liquid is difficult to have a fibrous form and the nonwoven fabric contains a lot of droplets, and that, if fibers can be obtained, the diameter of the fibers would become thick.

As a similar spinning apparatus, patent literature 2 proposes "an apparatus for forming nanofibers by using a pressurized gas stream comprising a center tube, a first supply tube that is positioned concentrically around and apart from the center tube, a middle gas tube positioned concentrically around and apart from the first supply tube, and a second supply tube positioned concentrically around and apart from the middle gas tube, wherein the center tube and first supply tube form a first annular column, the middle gas tube and the first supply tube form a second annular column, the middle gas tube and second supply tube form a third annular column, and the tubes are positioned so that first and second gas jet spaces are created between the lower ends of the center tube and first supply tube, and the middle gas tube and second supply tube, respectively". This apparatus also does not require the application of a high voltage, and can solve the problems. However, because the pressurized gas stream is applied to a spinning liquid annularly extruded, spinning cannot be stably performed, and the spinning liquid is difficult to have a fibrous form and the nonwoven fabric contains a lot of droplets.

Citation List

Patent Literature

[patent literature 1] Japanese Translation Publication (Kohyo) No. 2005-515316 (Abstract, Table 1, and the like)

[patent literature 2] U.S. Pat. No. 6,520,425 (Abstract, FIG. 2, and the like)

SUMMARY OF INVENTION

Technical Problem

An object of the present invention is to solve the above problems, that is, to provide a simple spinning apparatus capable of producing a nonwoven fabric consisting of fibers having a small fiber diameter, an apparatus for manufacturing a nonwoven fabric comprising this spinning apparatus, and a process for manufacturing a nonwoven fabric using this apparatus for manufacturing a nonwoven fabric.

Another object of the present invention is to provide a simple and energy-efficient spinning apparatus capable of producing a nonwoven fabric having a uniform uniformity and consisting of fibers having a small fiber diameter with a high productivity, and an apparatus for manufacturing a nonwoven fabric comprising this spinning apparatus.

Still another object of the present invention is to provide a process for manufacturing a nonwoven fabric having an excellent uniformity in which two or more types of fibers having a small fiber diameter and different in fiber diameter, resin composition, or the like are uniformly mixed, with a low energy consumption and a high productivity. The present invention relates to a process for manufacturing a nonwoven fabric capable of providing from a thin nonwoven fabric to a thick nonwoven fabric.

Solution to Problem

The present invention relates to

[1] a spinning apparatus comprising one or more exits for extruding liquid, which are capable of extruding a spinning liquid, and an exit for ejecting gas, which is located upstream of each of the exits for extruding liquid and is capable of ejecting a gas, wherein (1) the spinning apparatus comprises a columnar hollow for liquid (Hl), in which the exit for extruding liquid forms one end of the columnar hollow for liquid, (2) the spinning apparatus comprises a columnar hollow for gas (Hg) of which one end is the exit for ejecting gas, (3) a virtual column for liquid (Hvl) which is extended from the columnar hollow for liquid (Hl) is located adjacent to a virtual column for gas (Hvg) which is extended from the columnar hollow for gas (Hg), (4) a central axis of an extruding direction in the columnar hollow for liquid (Hl) is parallel to a central axis of an ejecting direction in the columnar hollow for gas (Hg), and (5) when the columnar hollow for gas and the columnar hollow for liquid are cross-sectioned with a plane perpendicular to the central axis of the columnar hollow for gas, there exists only one straight line having the shortest distance between an outer boundary of the cross-section of the columnar hollow for gas (Hg) and an outer boundary of the cross-section of the columnar hollow for liquid (Hl),

[2] the spinning apparatus of [1], wherein the spinning apparatus has one exit for extruding liquid,

[3] an apparatus for manufacturing a nonwoven fabric, characterized by comprising the spinning apparatus of [2] and a fibers collection means,

[4] a process for manufacturing a nonwoven fabric, characterized by using the apparatus of [3], and ejecting a gas having a flow rate of 100 m/sec. or more from the exit for ejecting gas of the spinning apparatus,

[5] the spinning apparatus of [1], wherein the spinning apparatus has two or more exits for extruding liquid, and (1) the spinning apparatus comprises columnar hollows for liquid, in which each of the exits for extruding liquid forms one end of the corresponding columnar hollow for liquid, (2) the spinning apparatus comprises the columnar hollow for gas of which one end is the exit for ejecting gas, (3) each virtual column for liquid which is extended from each of the columnar hollows for liquid is located adjacent to the virtual column for gas which is extended from the columnar hollow for gas, (4) each central axis of the extruding direction in each of the columnar hollows for liquid is parallel to the central axis of the ejecting direction in the columnar hollow for gas, and (5) when the columnar hollow for gas and the columnar hollows for liquid are cross-sectioned with a plane perpendicular to the central axis of the columnar hollow for gas, there exists only one straight line having the shortest distance between the outer boundary of the cross-section of the columnar hollow for gas and an outer boundary of the cross-section of each of the columnar hollows for liquid, at any combination of the columnar hollow for gas and each of the columnar hollows for liquid,

[6] the spinning apparatus of [5], characterized in that the outer shape of each exit for extruding liquid is circular,

[7] the spinning apparatus of [5] or [6], characterized in that the outer shape of the exit for ejecting gas is circular,

[8] an apparatus for manufacturing a nonwoven fabric, characterized by comprising the spinning apparatus of any one of [5] to [7] and a fibers collection means,

[9] a process for manufacturing a nonwoven fabric, characterized by using the apparatus of [8],

[10] a process for manufacturing a nonwoven fabric, characterized by using the apparatus of [8], and comprising the steps of extruding a spinning liquid from the exits for extruding liquid under two or more different extruding conditions to be fiberized, and accumulating the fiberized fibers on the fibers collection means to obtain a nonwoven fabric,

[11] the process of [10], characterized by extruding two or more types of spinning liquids different in concentration,

[12] the process of [10], characterized by extruding two or more types of spinning liquids containing different polymers, and

[13] the process of [10], characterized by extruding two or more types of spinning liquids containing different solvents.

Advantageous Effects of Invention

The spinning apparatus of [1] according to the present invention is a simple and energy-efficient apparatus capable of producing a nonwoven fabric consisting of fibers having a small fiber diameter.

The spinning apparatus of [2] according to the present invention is "a spinning apparatus comprising an exit for extruding liquid, which is capable of extruding a spinning liquid, and an exit for ejecting gas, which is located upstream of each of the exits for extruding liquid and is capable of ejecting a gas, wherein (1) the spinning apparatus comprises a columnar hollow for liquid (Hl), in which the exit for extruding liquid forms one end of the columnar hollow for liquid, (2) the spinning apparatus comprises a columnar hollow for gas (Hg) of which one end is the exit for ejecting gas, (3) a virtual column for liquid (Hvl) which is extended from the columnar hollow for liquid (Hl) is located adjacent to a virtual column for gas (Hvg) which is extended from the columnar hollow for gas (Hg), (4) a central axis of an extruding direction in the columnar hollow for liquid (Hl) is parallel to a central axis of an ejecting direction in the columnar hollow for gas (Hg), and (5) when the columnar hollow for gas and the columnar hollow for liquid are cross-sectioned with a plane perpendicular to the central axis of the columnar hollow for gas, there exists only one straight line having the shortest distance between an outer boundary of the cross-section of the columnar hollow for gas (Hg) and an outer boundary of the cross-section of the columnar hollow for liquid (Hl)".

In this apparatus, the spinning liquid extruded from the exit for extruding liquid is adjacent and parallel to the gas ejected from the exit for ejecting gas, and a shearing action of the gas and the accompanying airstream is single-linearly exerted on the spinning liquid, and therefore, fibers of which the diameter is thinned can be spun. This spinning apparatus is a simple and energy-efficient apparatus, because the application of a high voltage to the spinning liquid as well as the heating of the spinning liquid and the gas is not required.

The apparatus of [3] for manufacturing a nonwoven fabric, according to the present invention, comprises the fibers collection means, and therefore, fibers of which the diameter is thinned can be accumulated thereon to produce a nonwoven fabric.

In the process of [4] according to the present invention, when a gas having a flow rate of 100 m/sec. or more is ejected, generation of droplets can be avoided, and a nonwoven fabric comprising fibers of which the diameter is thinned can be efficiently produced.

The spinning apparatus of [5] according to the present invention is "a spinning apparatus comprising two or more exits for extruding liquid, which are capable of extruding a spinning liquid, and an exit for ejecting gas, which is located upstream of each of the exits for extruding liquid and is capable of ejecting a gas, wherein (1) the spinning apparatus comprises columnar hollows for liquid, in which each of the exits for extruding liquid forms one end of the corresponding columnar hollow for liquid, (2) the spinning apparatus comprises the columnar hollow for gas of which one end is the exit for ejecting gas, (3) each virtual column for liquid which is extended from each of the columnar hollows for liquid is located adjacent to the virtual column for gas which is extended from the columnar hollow for gas, (4) each central axis of the extruding direction in each of the columnar hollows for liquid is parallel to the central axis of the ejecting direction in the columnar hollow for gas, and (5) when the columnar hollow for gas and the columnar hollows for liquid are cross-sectioned with a plane perpendicular to the central axis of the columnar hollow for gas, there exists only one straight line having the shortest distance between the outer boundary of the cross-section of the columnar hollow for gas and an outer boundary of the cross-section of each of the columnar hollows for liquid, at any combination of the columnar hollow for gas and each of the columnar hollows for liquid".

In this apparatus, each of the spinning liquids extruded from each of the exits for extruding liquid is independently adjacent and parallel to the gas ejected from the exit for ejecting gas, and the shearing action of the gas and the accompanying airstream is independently and single-linearly exerted on each of the spinning liquids, and therefore, fibers of which the diameter is thinned can be spun. This spinning apparatus is a simple and energy-efficient apparatus, because the application of a high voltage to each spinning liquid is not required. Further, because the spinning liquids extruded from two or more exits for extruding liquid can be fiberized by the gas ejected from only one exit for ejecting gas, the amount of the gas can be reduced, and as a result, the scattering of fibers can be avoided, and a nonwoven fabric having an excellent uniformity can be produced with a high productivity. Furthermore, this spinning apparatus is an energy-efficient apparatus, because the amount of the gas can be reduced, and a high-capacity suction apparatus is not required.

In the spinning apparatus of [6] according to the present invention, because the outer shape of each of the exits for extruding liquid is circular, the shearing action of the gas ejected from the exit for ejecting gas and the accompanying airstream can be efficiently and single-linearly exerted on each cylindrical spinning liquid extruded from each of the exits for extruding liquid, and fibers of which the diameter is thinned can be easily spun.

In the spinning apparatus of [7] according to the present invention, because the outer shape of the exit for ejecting gas is circular, wherever each exit for extruding liquid is arranged with respect to the exit for ejecting gas, each spinning liquid extruded from each exit for extruding liquid may be independently and single-linearly subjected to the shearing action of the gas ejected from the exit for ejecting gas and the accompanying airstream to easily spin fibers of which the diameter is thinned.

The apparatus of [8] for manufacturing a nonwoven fabric, according to the present invention, comprises the fibers collection means, and therefore, fibers of which the diameter is thinned can be accumulated thereon to produce a nonwoven fabric with a high productivity.

In the process of [8] or [9] according to the present invention, each of the spinning liquids extruded from each of the exits for extruding liquid is independently adjacent and parallel to the gas ejected from the exit for ejecting gas, and the shearing action of the gas and the accompanying airstream is independently and single-linearly exerted on each of the spinning liquids, and therefore, fibers of which the diameter is thinned can be spun. Further, because the spinning liquids extruded from two or more exits for extruding liquid can be fiberized by the gas ejected from only one exit for ejecting gas, the amount of the gas can be reduced, and as a result, the scattering of fibers can be avoided, and a nonwoven fabric having an excellent uniformity can be produced with a high productivity. In this regard, this spinning apparatus is an energy-efficient apparatus, because the amount of the gas can be reduced, and a high-capacity suction apparatus as well as the application of a high voltage to each spinning liquid is not required. Furthermore, from a thin nonwoven fabric to a thick nonwoven fabric can be produced, because the amount of the gas can be reduced, and a suction is not necessary to be enhanced. Still furthermore, because one or more spinning liquids are extruded from the exits for extruding liquid under two or more different extruding conditions to be fiberized in the process of [9] according to the present invention, a nonwoven fabric having an excellent uniformity in which two or more different types of fibers in fiber diameter, resin composition, or the like are uniformly mixed can be produced.

In the process of [11] according to the present invention, a nonwoven fabric having an excellent uniformity in which two or more types of fibers different in fiber diameter are uniformly mixed can be produced by extruding two or more types of spinning liquid different in concentration.

In the process of [12] according to the present invention, a nonwoven fabric having an excellent uniformity in which two or more types of fibers different in resin composition are uniformly mixed can be produced by extruding two or more types of spinning liquid containing different polymers.

In the process of [13] according to the present invention, a nonwoven fabric having an excellent uniformity in which two or more types of fibers different in fiber diameter are uniformly mixed can be produced by extruding two or more types of spinning liquid containing different solvents.

BRIEF DESCRIPTION OF DRAWINGS

[FIG. 1]

(a) FIG. 1(*a*) is an enlarged perspective view showing the tip portion of an embodiment of the spinning apparatus of the present invention.

(b) FIG. 1(*b*) is a cross-sectional view taken along plane C in FIG. 1(*a*).

FIG. 2 is a cross-sectional view of a conventional spinning apparatus.

FIG. 3 is a cross-sectional plane view showing the arrangement of the nozzle for extruding liquid and the nozzle for ejecting gas used in Comparative Example 1.

Figure 4:
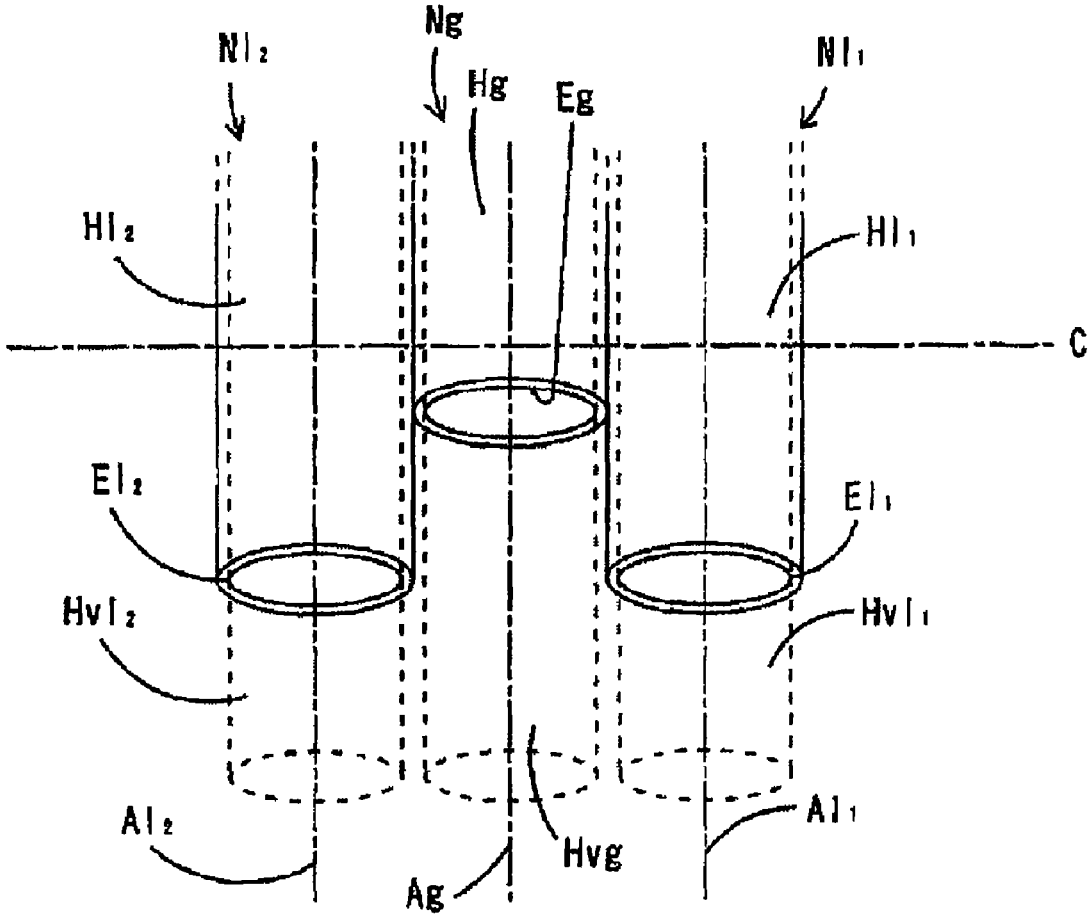

FIG. 4 is an enlarged perspective view showing the tip portion of another embodiment of the spinning apparatus of the present invention.

[FIG. 5]

Figure 5:
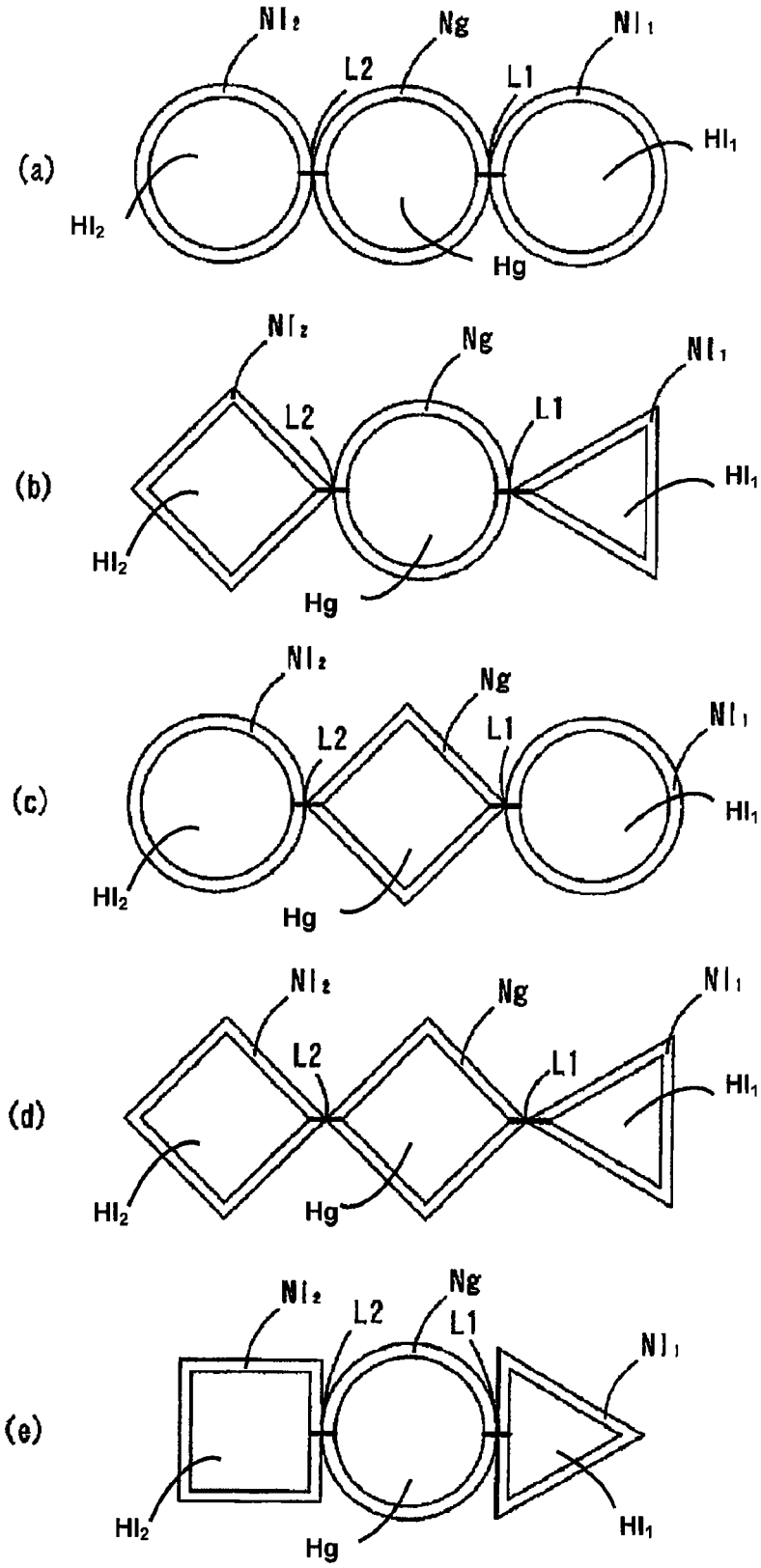

(a) FIG. 5(*a*) is a cross-sectional plane view of an embodiment, taken along the plane perpendicular to the central axis of the columnar hollow for gas (a cross-sectional plane view taken along plane C in FIG. 4).

(b) FIG. 5(*b*) is a cross-sectional plane view of another embodiment, taken along the plane perpendicular to the central axis of the columnar hollow for gas.

(c) FIG. 5(*c*) is a cross-sectional plane view of still another embodiment, taken along the plane perpendicular to the central axis of the columnar hollow for gas.

(d) FIG. 5(*d*) is a cross-sectional plane view of still another embodiment, taken along the plane perpendicular to the central axis of the columnar hollow for gas.

(e) FIG. 5(*e*) is a cross-sectional plane view of still another embodiment, taken along the plane perpendicular to the central axis of the columnar hollow for gas.

[FIG. 6]

(a) FIG. 6(*a*) is a cross-sectional plane view of an embodiment, taken along the plane perpendicular to the central axis of the columnar hollow for gas.

(b) FIG. 6(*b*) is a cross-sectional plane view of another embodiment, taken along the plane perpendicular to the central axis of the columnar hollow for gas.

(c) FIG. 6(*c*) is a cross-sectional plane view of still another embodiment, taken along the plane perpendicular to the central axis of the columnar hollow for gas.

DESCRIPTION OF EMBODIMENTS

The spinning apparatus of the present invention will be explained with reference to FIG. 1(*a*) that is an enlarged perspective view showing the tip portion of an embodiment of the spinning apparatus of the present invention, and FIG. 1(*b*) that is a cross-sectional view taken along plane C in FIG. 1(*a*).

The spinning apparatus of the present invention contains a single nozzle for extruding liquid (Nl) having, at one end thereof, an exit for extruding liquid (El) capable of extruding a spinning liquid, and a single nozzle for ejecting gas (Ng) having, at one end thereof, an exit for ejecting gas (Eg) capable of ejecting a gas; the outer wall of the former nozzle (Nl) is directly contacted with the outer wall of the latter nozzle (Ng); and the exit for ejecting gas (Eg) of the nozzle for ejecting gas (Ng) is located upstream of the exit for extruding liquid (El). The nozzle for extruding liquid (Nl) has a columnar hollow for liquid (Hl) of which one end is the exit for extruding liquid (El), and the nozzle for ejecting gas (Ng) has a columnar hollow for gas (Hg) of which one end is the exit for ejecting gas (Eg). A virtual column for liquid (Hvl) which is extended from the columnar hollow for liquid (Hl) is located adjacent to a virtual column for gas (Hvg) which is extended from the columnar hollow for gas (Hg), and the distance between these virtual columns corresponds to the sum of the wall thickness of the nozzle for extruding liquid (Nl) and the wall thickness of the nozzle for ejecting gas (Ng). The central axis of the extruding direction (Al) of the columnar hollow for liquid (Hl) is parallel to the central axis of the ejecting direction (Ag) of the columnar hollow for gas (Hg). As shown in FIG. 1(*b*) that is a cross-sectional view taken along plane C perpendicular to the central axis of the columnar hollow for gas (Hg), the outer shape of a cross-section of the columnar hollow for gas (Hg), and the outer shape of a cross-section of the columnar hollow for liquid (Hl) are circular, and only a single straight line ($L_1$) having the shortest distance between the outer boundaries of these cross-sections can be drawn.

In this spinning apparatus as shown in FIG. 1, when a spinning liquid and a gas are supplied to the nozzle for extruding liquid (Nl) and the nozzle for ejecting gas (Ng), respectively, the spinning liquid flows through the columnar hollow for liquid (Hl) and is extruded from the exit for extruding liquid (El) in the axis direction of the columnar hollow for liquid (Hl), and simultaneously, the gas flows through the columnar hollow for gas (Hg) and is ejected from the exit for ejecting gas (Eg) in the axis direction of the columnar hollow for gas (Hg). The ejected gas is adjacent to the extruded spinning liquid, the ejecting direction of the gas is parallel to the extruding direction of the spinning liquid, and there exists only a single point having the shortest distance between the ejected gas and the extruded spinning liquid on plane C, that is, the spinning liquid is single-linearly subjected to a shearing action of the gas and the accompanying airstream, and therefore, the spinning liquid is spun in the axis direction of the columnar hollow for liquid (Hl) while the diameter thereof is thinned, and simultaneously, the spinning liquid is fiberized by evaporating the solvent contained in the spinning liquid. As described above, the spinning apparatus as shown in FIG. 1 does not require the application of a high voltage to the spinning liquid, as well as the heating of the spinning liquid and the gas, and is a simple and energy-efficient apparatus.

The nozzle for extruding liquid (Nl) may be any nozzle capable of extruding a spinning liquid, and the shape of the exit for extruding liquid (El) is not particularly limited. The shape of the exit for extruding liquid (El) may be, for example, circular, oval, elliptical, or polygonal (such as triangle, quadrangle, or hexagonal), and is preferably circular, because the shearing action of the gas and the accompanying airstream can be single-linearly exerted on the spinning liquid, and generation of droplets can be avoided. When the shape of the exit for extruding liquid (El) is polygonal, the shearing action of the gas and the accompanying airstream can be single-linearly exerted on the spinning liquid, by arranging one vertex of the polygon at the side of the nozzle for ejecting gas (Ng), and as a result, generation of droplets can be avoided. That is to say, when the columnar hollow for gas (Hg) and the columnar hollow for liquid (Hl) are cross-sectioned with a plane perpendicular to the central axis of the columnar hollow for gas (Hg), only a single straight line having the shortest distance between the outer boundary of the cross-section of the columnar hollow for gas (Hg) and the outer boundary of the cross-section of the columnar hollow for liquid (Hl) can be drawn, and therefore, the extruded spinning liquid is single-linearly subjected to the shearing action of the gas and the accompanying airstream, and as a result, generation of droplets can be avoided.

The size of the exit for extruding liquid (El) is not particularly limited, but is preferably 0.03 to 20 $mm^2$, more preferably 0.03 to 0.8 $mm^2$. When the size is less than 0.03 $mm^2$, it tends to become difficult to extrude a spinning liquid having a high viscosity. When the size is more than 20 $mm^2$, it tends to become difficult to exert the shearing action on the overall spinning liquid extruded, and therefore, droplets are liable to occur.

The nozzle for extruding liquid (Nl) may be formed of any material such as a metal or a resin, and a resin or metal tube may be used as the nozzle. Although FIG. 1 shows a cylindrical nozzle for extruding liquid (Nl), a nozzle having an acute-angled edge in which a tip portion is slantingly cut away with a plane may be used. This nozzle having an acute-angled edge is advantageous to a spinning liquid having a high viscosity. When the nozzle having an acute-angled edge is used so that the acute-angled edge is arranged at the side of the nozzle for ejecting gas, the spinning liquid may be effectively subjected to the shearing action of the gas and the accompanying airstream, and therefore, may be stably fiberized.

The nozzle for ejecting gas (Ng) may be any nozzle capable of ejecting a gas, and the shape of the exit for ejecting gas (Eg) is not particularly limited. The shape of the exit for ejecting gas (Eg) may be, for example, circular, oval, elliptical, or polygonal (such as triangle, quadrangle, or hexagonal), and is preferably circular, because the spinning liquid is effectively subjected to the shearing action of the gas and the accompanying airstream. When the shape of the exit for ejecting gas (Eg) is polygonal, and one of the vertices of the polygon is arranged at the side of the nozzle for extruding liquid (Nl), the shearing action of the gas and the accompanying airstream can be efficiently exerted on the spinning liquid. That is to say, when the columnar hollow for gas (Hg) and the columnar hollow for liquid (Hl) are cross-sectioned with a plane perpendicular to the central axis of the columnar hollow for gas (Hg), only a single straight line having the shortest distance between the outer boundary of the cross-section of the columnar hollow for gas (Hg) and the outer boundary of the cross-section of the columnar hollow for liquid (Hl) can be drawn, and therefore, the extruded spinning liquid is single-linearly subjected to the shearing action of the gas and the accompanying airstream, and as a result, generation of droplets can be avoided.

The size of the exit for ejecting gas (Eg) is not particularly limited, but is preferably 0.03 to 79 $mm^2$, more preferably 0.03 to 20 $mm^2$. When the size is less than 0.03 $mm^2$, it tends to become difficult to exert the shearing action on the overall spinning liquid extruded, and therefore, it tends to become difficult to be stably fiberized. When the size is more than 79 $mm^2$, a flow rate sufficient to exert the shearing action on the spinning liquid, that is, a large amount of gas, is required, and it is wasteful. The size of the exit for ejecting gas (Eg) is preferably as same as, or larger than, that of the exit for extruding liquid (El), because the spinning liquid is effectively subjected to the shearing action of the gas and the accompanying airstream.

The nozzle for ejecting gas (Ng) may be formed of any material such as a metal or a resin, and a resin or metal tube may be used as the nozzle.

Because the nozzle for ejecting gas (Ng) is arranged so that the exit for ejecting gas (Eg) is located upstream (i.e., at the side where a spinning liquid is supplied) of the exit for extruding liquid (El), the spinning liquid can be prevented from rising around the exit for extruding liquid. As a result, the exit for extruding liquid is not soiled with the spinning liquid, and spinning may be carried out over a long period. The distance between the exit for ejecting gas (Eg) and the exit for extruding liquid (El) is not particularly limited, but is preferably 10 mm or less, more preferably 5 mm or less. When this distance is more than 10 mm, the shearing action of the gas and the accompanying airstream is not sufficiently exerted on the spinning liquid, and it tends to become difficult to be fiberized. The lower limit of the distance between the exit for ejecting gas (Eg) and the exit for extruding liquid (El) is not particularly limited, so long as the exit for ejecting gas (Eg) does not accord with the exit for extruding liquid (El).

The columnar hollow for liquid (Hl) is a passage which the spinning liquid flows through, and forms the shape of the spinning liquid when extruded. The columnar hollow for gas (Hg) is a passage which the gas flows through, and forms the shape of the gas when ejected.

The virtual column for liquid (Hvl), which is extended from the columnar hollow for liquid (Hl), is a flight route of the spinning liquid immediately after being extruded from the exit for extruding liquid (El). The virtual column for gas (Hvg), which is extended from the columnar hollow for gas (Hg), is an ejection route of the gas immediately after being ejected from the exit for ejecting gas (Eg). The distance between the virtual column for liquid (Hvl) and the virtual column for gas (Hvg) corresponds to the sum of the wall thickness of the nozzle for extruding liquid (Nl) and the wall thickness of the nozzle for ejecting gas (Ng), and preferably 2 mm or less, more preferably 1 mm or less. When this distance is more than 2 mm, the shearing action of the gas and the accompanying airstream is not sufficiently exerted on the spinning liquid, and it tends to become difficult to be fiberized.

The virtual column for liquid (Hvl) and the virtual column for gas (Hvg) are columns of which the inside is filled. For example, in a case where a cylindrical virtual portion for liquid is covered with a hollow-cylindrical virtual portion for gas (or in a case where a cylindrical virtual portion for gas is covered with a hollow-cylindrical virtual portion for liquid), when the virtual column for gas and the virtual column for liquid are cross-sectioned with a plane perpendicular to the central axis of the virtual column for gas, there exist an infinite number of straight lines having the shortest distance between the outer boundary of the cross-section of the virtual portion for liquid and the inner boundary of the cross-section of the virtual portion for gas (or between the outer boundary of the cross-section of the virtual portion for gas and the inner boundary of the cross-section of the virtual portion for liquid). Therefore, the shearing action of the gas and the accompanying airstream is exerted on the spinning liquid at various points, and as a result, the spinning liquid is not sufficiently fiberized, and a lot of droplets occur. These "virtual columns" are portions which are extended from the inner walls of the nozzles, respectively.

Because the central axis of the extruding direction (Al) of the columnar hollow for liquid (Hl) is parallel to the central axis of the ejecting direction (Ag) of the columnar hollow for gas (Hg), the shearing action of the gas and the accompanying airstream can be single-linearly exerted on the extruded spinning liquid, and thus, fibers can be stably formed. When these central axes coincide with each other, for example, in a case where a cylindrical hollow portion for liquid is covered with a hollow-cylindrical hollow portion for gas, or in a case where a cylindrical hollow portion for gas is covered with a hollow-cylindrical hollow portion for liquid, the shearing action of the gas and the accompanying airstream cannot be single-linearly exerted on the spinning liquid, and as a result, the spinning liquid is not sufficiently fiberized, and a lot of droplets occur. Alternatively, when these central axes are skew, or intersect with each other, the shearing action of the gas and the accompanying airstream is not exerted, or is not uniform if exerted, and thus, the spinning liquid is not stably fiberized. The term "parallel" means that the central axis of the extruding direction (Al) of the columnar hollow for liquid (Hl) and the central axis of the ejecting direction (Ag) of the columnar hollow for gas (Hg) are coplanar and parallel. The term "the central axis of the extruding (or ejecting) direction" means the line that is bounded by the center of the exit for extruding liquid (or for ejecting gas) and the center of the cross-section of the virtual column for liquid (or for gas).

In the spinning apparatus of the present invention, when the columnar hollow for gas (Hg) and the columnar hollow for liquid (Hl) are cross-sectioned with a plane perpendicular to the central axis of the columnar hollow for gas (Hg), only a single straight line having the shortest distance between the outer boundary of the cross-section of the columnar hollow for gas (Hg) and the outer boundary of the cross-section of the columnar hollow for liquid (Hl) can be drawn [FIG. 1(*b*)]. Because the gas ejected from the columnar hollow for gas and the accompanying airstream single-linearly act on the spinning liquid extruded from the columnar hollow for liquid, the shearing action is single-linearly exerted on the spinning liquid to thereby perform stable spinning without generation of droplets. For example, when two straight lines can be drawn, because the shearing action is not stably exerted, for example, on one point and on another point by turns, droplets occur and stable spinning cannot be carried out.

Although not shown in FIG. 1(*a*), the nozzle for extruding liquid (Nl) is connected to a reservoir for a spinning liquid (for example, a syringe, a stainless steel tank, a plastic tank, or a bag made of a resin, such as a vinyl chloride resin or a polyethylene resin), and the nozzle for ejecting gas (Ng) is connected to a gas supply equipment (for example, a compressor, a gas cylinder, or a blower).

Although FIG. 1 shows a set of spinning apparatus, two or more sets of spinning apparatus can be arranged. The productivity can be improved by arranging two or more sets of spinning apparatus.

FIG. 1 shows an embodiment in which the nozzle for extruding liquid (Nl) and the nozzle for ejecting gas (Ng) are fixed, but the present invention is not limited to this embodiment shown in FIG. 1, so long as these nozzles comply with the relations as described above. Such nozzles may be prepared by, for example, boring a base material having a step height to form the columnar hollow for liquid (Hl) and the columnar hollow for gas (Hg). The spinning apparatus may comprise a means capable of freely adjusting the position of the exit for extruding liquid (El) of the nozzle for extruding liquid (Nl) and/or the position of the exit for ejecting gas (Eg) of the nozzle for ejecting gas (Ng).

The apparatus of the present invention for manufacturing a nonwoven fabric comprises a fibers collection means as well as the spinning apparatus as described above, and thus, a nonwoven fabric can be produced by collecting fibers.

The fibers collection means may be any support capable of directly accumulating fibers thereon, for example, a nonwoven fabric, a woven fabric, a knitted fabric, a net, a drum, a belt, or a flat plate. Because the gas is ejected in the present invention, it is preferable that an air-permeable support is used and a suction apparatus is arranged on the opposite side of the fibers collection means from the spinning apparatus, so that fibers are easily accumulated and the collected fibers are not disturbed by suction of the gas.

It is preferable that the fibers collection means is arranged opposite to the exit for ejecting gas (Ng) of the spinning apparatus, because fibers can be properly captured to produce a nonwoven fabric. It is most preferable that the fibers collection means is arranged so that the surface thereof for capturing fibers is perpendicular to the central axis of the ejecting direction of gas (Ag). In this regard, even if the fibers collection means is arranged so that the surface thereof for capturing fibers is parallel to the central axis of the ejecting direction of gas (Ag), fibers can be accumulated on the fibers collection means, by locating the fibers collection means downward in the gravity direction and sufficiently far from the exit for ejecting gas so that the spinning force of the fibers is lost, or by applying a gas stream capable of changing the spinning direction. Therefore, the central axis of the ejecting direction of gas (Ag) of the spinning apparatus may intersect with the gravity direction.

When the fibers collection means is arranged opposite to the exit for ejecting gas (Eg) of the spinning apparatus, the distance between the fibers collection means and the exit for extruding liquid (El) of the spinning apparatus varies in accordance with the amount of a spinning liquid extruded or the flow rate of a gas, and is not particularly limited, but is preferably 50 to 1000 mm. When this distance is less than 50 mm, a nonwoven fabric sometimes cannot be obtained, because fibers are accumulated, while the solvent contained in the spinning liquid does not completely evaporate and remains, and the shape of each fiber accumulated cannot be maintained. When this distance is more than 1000 mm, the gas flow is liable to be disturbed, and therefore, the fibers are liable to be broken and scattered.

In addition to the fibers collection means, the apparatus of the present invention for manufacturing a nonwoven fabric preferably comprises a container for spinning capable of containing the spinning apparatus and the fibers collection means. When the apparatus is equipped with the container for spinning, the diffusion of the solvent evaporated from the spinning liquid can be avoided and, in some cases, the solvent can be recovered to be re-used. When the spinning apparatus and the fibers collection means are contained in the spinning container, it is preferable that an exhaust apparatus other than the suction apparatus to suction the fibers is connected to the spinning container. When spinning is carried out, the concentration of solvent vapor in the spinning container is gradually increased to suppress the evaporation of the solvent, and as a result, unevenness of fiber diameters is liable to occur, and it tends to become difficult to be fiberized. However, the unevenness of fiber diameter can be lowered and fiberization can be stably performed, by exhausting the gas from the spinning container to maintain a constant concentration of the solvent contained in the spinning container. Further, it is preferable that a supply equipment of a gas of which the temperature and humidity are controlled is connected to the spinning container, because the concentration of solvent vapor in the spinning container can be stabilized, and the unevenness of fiber diameter can be lowered.

The process of the present invention for manufacturing a nonwoven fabric is a process using the above apparatus for manufacturing a nonwoven fabric, and ejecting a gas having a flow rate of 100 m/sec. or more from the exit for ejecting gas (Eg) of the spinning apparatus. Generation of droplets can be avoided, and a nonwoven fabric containing fibers of which the diameter is thinned can be efficiently produced by ejecting the gas having a flow rate of 100 m/sec. or more from the exit for ejecting gas (Eg). The gas is ejected at a flow rate of, preferably 150 m/sec. or more, more preferably 200 m/sec. or more. The upper limit of the gas flow rate is not particularly limited, so long as the fibers accumulated on the fibers collection means are not disturbed. A gas having such a flow rate can be ejected by, for example, supplying the gas to the columnar hollow for gas (Hg) from a compressor. The gas is not particularly limited, but air, a nitrogen gas, an argon gas, or the like may be used, and use of air is economical. The gas can contain vapor of a solvent which has an affinity for the spinning liquid or vapor of a solvent which lacks an affinity for the spinning liquid. By controlling the amount of vapor of a solvent, an evaporation rate of the solvent from the spinning liquid, or a solidification rate of the spinning liquid can be controlled, and as a result, the stability of spinning can be improved, or the fiber diameter can be controlled.

A spinning liquid used in the process of the present invention is not particularly limited, and may be any liquid prepared by dissolving a desired polymer in a solvent. More particularly, a spinning liquid prepared by dissolving one, or two or more polymers selected from, for example, polyethylene glycol, partially saponified polyvinyl alcohol, completely saponified polyvinyl alcohol, polyvinylpyrrolidone, polylactic acid, polyester, polyglycolic acid, polyacrylonitrile, polyacrylonitrile copolymer, polymethacrylic acid, polymethylmethacrylate, polycarbonate, polystyrene, polyamide, polyimide, polyethylene, or polypropylene, in one, or two or more solvents selected from, for example, water, acetone, methanol, ethanol, propanol, isopropanol, tetrahydrofuran, dimethylsulfoxide, 1,4-dioxane, pyridine, N,N-dimethylformamide, N,N-dimethylacetamide, N-methyl-2-pyrrolidone, acetonitrile, formic acid, toluene, benzene, cyclohexane, cyclohexanone, carbon tetrachloride, methylene chloride, chloroform, trichloroethane, ethylene carbonate, diethyl carbonate, or propylene carbonate, may be used.

The viscosity of a spinning liquid when spinning is carried out is preferably 10 to 10000 mPa·s, more preferably 20 to 8000 mPa·s. When the viscosity is less than 10 mPa·s, the spinning liquid exhibits a poor spinnability due to a low viscosity, and it tends to become difficult to have a fibrous form. When the viscosity is more than 10000 mPa·s, the spinning liquid is difficult to be drawn, and it tends to become difficult to have a fibrous form. Therefore, even if the viscosity at room temperature is more than 10000 mPa·s, such a spinning liquid may be used, provided that the viscosity falls within the preferable range by heating the spinning liquid per se or the columnar hollow for liquid (Hl). By contrast, even if the viscosity at room temperature is less than 10 mPa·s, such a spinning liquid may be used, provided that the viscosity rises within the preferable range by cooling the spinning liquid per se or the columnar hollow for liquid (Hl). The term "viscosity" as used herein means a value measured at the temperature same as that when spinning is carried out, using a viscometer, when the shear rate is 100 $s^{-1}$.

The amount of a spinning liquid extruded from the exit for extruding liquid (El) is not particularly limited, because it varies depending on the viscosity of the spinning liquid or the flow rate of a gas. It is preferably 0.1 to 100 $cm^3$/hour.

The spinning apparatus of the present invention will be explained with reference to FIG. 4 that is an enlarged perspective view showing the tip portion of an embodiment having two exits for extruding liquid and an exit for ejecting gas, and FIG. 5(*a*) that is a cross-sectional view taken along plane C in FIG. 4.

The spinning apparatus of the present invention contains a first nozzle for extruding liquid ($Nl_1$) having, at one end thereof, a first exit for extruding liquid ($El_1$) capable of extruding a spinning liquid, a second nozzle for extruding liquid ($Nl_2$) having, at one end thereof, a second exit for extruding liquid ($El_2$) capable of extruding a spinning liquid, and a nozzle for ejecting gas (Ng) having, at one end thereof, an exit for ejecting gas (Eg) capable of ejecting a gas; the outer walls of the nozzles for extruding liquid ($Nl_1$, $Nl_2$) are directly contacted with the outer wall of the nozzle for ejecting gas (Ng) so that the nozzle for ejecting gas (Ng) is sandwiches between the nozzles for extruding liquid ($Nl_1$ and $Nl_2$); and the exit for ejecting gas (Eg) of the nozzle for ejecting gas (Ng) is located upstream of each of the first exit for extruding liquid ($El_1$) and the second exit for extruding liquid ($El_2$). The first nozzle for extruding liquid ($Nl_1$) has a first columnar hollow for liquid ($Hl_1$) of which one end is the first exit for extruding liquid ($El_1$), the second nozzle for extruding liquid ($Nl_2$) has a second columnar hollow for liquid ($Hl_2$) of which one end is the second exit for extruding liquid ($El_2$), and the nozzle for ejecting gas (Ng) has a columnar hollow for gas (Hg) of which one end is the exit for ejecting gas (Eg). A first virtual column for liquid ($Hvl_1$) which is extended from the first columnar hollow for liquid ($Hl_1$) is located adjacent to a virtual column for gas (Hvg) which is extended from the columnar hollow for gas (Hg), and the distance between these virtual columns corresponds to the sum of the wall thickness of the first nozzle for extruding liquid 11) and the wall thickness of the nozzle for ejecting gas (Ng); and the second virtual column for liquid ($Hvl_2$) which is extended from the second columnar hollow for liquid ($Hl_2$) is located adjacent to a virtual column for gas (Hvg) which is extended from the columnar hollow for gas (Hg), and the distance between these virtual columns corresponds to the sum of the wall thickness of the second nozzle for extruding liquid ($Nl_2$) and the wall thickness of the nozzle for ejecting gas (Ng). The first central axis of the extruding direction ($Al_1$) of the first columnar hollow for liquid ($Hl_1$) is parallel to the central axis of the ejecting direction (Ag) of the columnar hollow for gas (Hg); and the second central axis of the extruding direction ($Al_2$) of the second columnar hollow for liquid ($Hl_2$) is parallel to the central axis of the ejecting direction (Ag) of the columnar hollow for gas (Hg). When the columnar hollow for gas (Hg) and the columnar hollows for liquid ($Hl_1$, $Hl_2$) are cross-sectioned with a plane perpendicular to the central axis (Ag) of the columnar hollow for gas (Hg), the outer shape of a cross-section of the columnar hollow for gas (Hg), and the outer shape of a cross-section of each of the columnar hollows for liquid ($Hl_1$, $Hl_2$) are circular, and only one straight line (L1, L2) having the shortest distance between the outer boundary of the cross-section of the columnar hollow for gas (Hg) and the outer boundary of the cross-section of each of the columnar hollows for liquid ($Hl_1$, $Hl_2$), at any combination of the columnar hollow for gas and each of the columnar hollows for liquid, can be drawn [see FIG. 5(*a*)].

In this spinning apparatus as shown in FIG. 4, when spinning liquids are supplied to the first nozzle for extruding liquid ($Nl_1$) and the second nozzle for extruding liquid ($Nl_2$), and a gas is supplied to the nozzle for ejecting gas (Ng), the spinning liquids supplied to the first and second nozzles flow through the first columnar hollow for liquid ($Hl_1$) and the second columnar hollow for liquid ($Hl_2$), and are extruded from the first exit for extruding liquid ($El_1$) and the second exit for extruding liquid ($El_2$), in the first axis direction of the first columnar hollow for liquid ($Hl_1$) and the second axis direction of the second columnar hollow for liquid ($Hl_2$), respectively, and simultaneously, the gas flows through the columnar hollow for gas (Hg) and is ejected from the exit for ejecting gas (Eg) in the axis direction of the columnar hollow for gas (Hg). The ejected gas is adjacent to each of the extruded spinning liquids, the central axis (Ag) of the ejected gas is parallel to the central axis ($Al_1$, $Al_2$) of each of the extruded spinning liquids at the closest range of each exit for extruding liquid, and there exists only a single point having the shortest distance between the ejected gas and each of the extruded spinning liquids on plane C at any combination, that is, each spinning liquid is single-linearly subjected to the shearing action of the gas and the accompanying airstream, and therefore, each spinning liquid is spun in the first axis direction of the first columnar hollow for liquid ($Hl_1$) or the second axis direction of the second columnar hollow for liquid ($Hl_2$) while the diameter thereof is thinned, and simultaneously, each spinning liquid is fiberized by evaporating the solvent contained in each spinning liquid. As described above, the spinning apparatus as shown in FIG. 4 does not require the application of a high voltage to each of the spinning liquids, and is a simple and energy-efficient apparatus. Because two spinning liquids can be spun and fiberized by only a gas stream, the amount of the gas can be reduced, and as a result, the scattering of fibers can be avoided, and a nonwoven fabric having an excellent uniformity can be produced with a high productivity. Further, the spinning apparatus is an energy-efficient apparatus, because the amount of the gas can be reduced, and a high-capacity suction apparatus is not required. Furthermore, from a thin nonwoven fabric to a thick nonwoven fabric can be produced, because a suction is not necessary to be enhanced.

The first nozzle for extruding liquid ($Nl_1$) and the second nozzle for extruding liquid ($Nl_2$) may be any nozzle capable of extruding a spinning liquid, and the outer shape of each of the first exit for extruding liquid ($El_1$) and the second exit for extruding liquid ($El_2$) is not particularly limited. The outer shape of each of the first and second exits for extruding liquid ($El_1$, $El_2$) may be, for example, circular, oval, elliptical, or polygonal (such as triangle, quadrangle, or hexagonal), and is preferably circular, because the shearing action of the gas and the accompanying airstream can be single-linearly exerted on each of the spinning liquids, and generation of droplets can be avoided. That is to say, when the first and second nozzles for extruding liquid ($Nl_1$, $Nl_2$) have a circular outer shape, and the columnar hollow for gas (Hg) and the columnar hollows for liquid ($Hl_1$, $Hl_2$) are cross-sectioned with a plane perpendicular to the central axis (Ag) of the columnar hollow for gas (Hg), there is a tendency that only one straight line (L1, L2) having the shortest distance between the outer boundary of the cross-section of the columnar hollow for gas (Hg) and the outer boundary of the cross-section of each of the columnar hollows for liquid ($Hl_1$, $Hl_2$), at any combination of the columnar hollow for gas and each of the columnar hollows for liquid, can be drawn, and as a result, the shearing action of the gas and the accompanying airstream is single-linearly exerted on each of the spinning liquids, and generation of droplets can be avoided. The outer shape of the first exit for extruding liquid ($El_1$) may be the same as, or different from, that of the second exit for extruding liquid ($El_2$), but it is preferable that both outer shapes are circular.

When the first and second exits for extruding liquid ($El_1$, $El_2$) have a polygonal shape, it is preferable that these exits are arranged so that one vertex of each polygon is at the side of the nozzle for ejecting gas (Ng), because the shearing action of the gas and the accompanying airstream is single-linearly exerted on each of the spinning liquids, and generation of droplets can be avoided. That is to say, in a case where the first and second nozzles for extruding liquid ($Nl_1$, $Nl_2$) are arranged so that, when the columnar hollow for gas (Hg) and the first and second columnar hollows for liquid ($Hl_1$, $Hl_2$) are cross-sectioned with a plane perpendicular to the central axis (Ag) of the columnar hollow for gas (Hg), only one straight line [L1, L2 in FIG. 5(*a*) to FIG. 5(*e*)] having the shortest distance between the outer boundary of the cross-section of the columnar hollow for gas (Hg) and the outer boundary of the cross-section of each of the first and second columnar hollows for liquid ($Hl_1$, $Hl_2$), at any combination of the columnar hollow for gas and each of the columnar hollows for liquid, can be drawn, the shearing action of the gas and the accompanying airstream is single-linearly exerted on each of the spinning liquids, and as a result, stable spinning can be performed, and generation of droplets can be avoided. Therefore, when the exit for ejecting gas (Eg) has a circular shape, it is possible to arrange these nozzles so that one side of each of the first and second exits for extruding liquid ($El_1$, $El_2$) is at the side of the nozzle for ejecting gas (Ng) [see FIG. 5(*e*)].

The size of each of the first exit for extruding liquid ($El_1$) and the second exit for extruding liquid ($El_2$) is not particularly limited, but is preferably 0.01 to 20 $mm^2$, more preferably 0.01 to 2 $mm^2$. When the size is less than 0.01 $mm^2$, it tends to become difficult to extrude a spinning liquid having a high viscosity. When the size is more than 20 $mm^2$, it tends to become difficult to single-linearly exert the action of the gas and the accompanying airstream on the spinning liquid, and therefore, it tends to become difficult to be stably spun.

The first nozzle for extruding liquid ($Nl_1$) and the second nozzle for extruding liquid ($Nl_2$) may be formed of any material such as a metal or a resin, and a resin or metal tube may be used as the nozzles. Although FIG. 4 shows cylindrical first and second nozzles for extruding liquid ($Nl_1$, $Nl_2$), a nozzle having an acute-angled edge in which a tip portion is slantingly cut away with a plane may be used as the nozzles. This nozzle having an acute-angled edge is advantageous to a spinning liquid having a high viscosity. When the nozzle having an acute-angled edge is used so that the acute-angled edge is arranged at the side of the nozzle for ejecting gas, the spinning liquid may be effectively subjected to the shearing action of the gas and the accompanying airstream, and therefore, may be stably fiberized.

Although FIG. 4 shows two nozzles, i.e., the first and second nozzles for extruding liquid ($Nl_1$, $Nl_2$), the number of the nozzles for extruding liquid is not limited to two, and may be three or more (see FIG. 6). Embodiments having many nozzles can efficiently use the gas to produce a nonwoven fabric with a high productivity.

The nozzle for ejecting gas (Ng) may be any nozzle capable of ejecting a gas, and the shape of the exit for ejecting gas (Eg) is not particularly limited. The shape of the exit for ejecting gas (Eg) may be, for example, circular, oval, elliptical, or polygonal (such as triangle, quadrangle, or hexagonal), and is preferably circular. This is because wherever each exit for extruding liquid is arranged with respect to the exit for ejecting gas, each spinning liquid extruded from each exit for extruding liquid may be independently and single-linearly subjected to the shearing action of the gas ejected from the exit for ejecting gas and the accompanying airstream to easily spin fibers of which the diameter is thinned. When the exit for ejecting gas (Eg) has a polygonal shape, the shearing action of the gas and the accompanying airstream may be efficiently exerted on the spinning liquid, by arranging the nozzles so that one vertex of the polygon is at the side of the first nozzle for extruding liquid ($Nl_1$) and another vertex thereof is at the side of the second nozzle for extruding liquid ($Nl_2$). That is to say, as previously described, in a case where the first and second nozzles for extruding liquid ($Nl_1$, $Nl_2$) are arranged so that, when the columnar hollow for gas (Hg) and the first and second columnar hollows for liquid ($Hl_1$, $Hl_2$) are cross-sectioned with a plane perpendicular to the central axis (Ag) of the columnar hollow for gas (Hg), only one straight line (L1, L2) having the shortest distance between the outer boundary of the cross-section of the columnar hollow for gas (Hg) and the outer boundary of the cross-section of each of the first and second columnar hollows for liquid ($Hl_1$, $Hl_2$), at any combination of the columnar hollow for gas and each of the columnar hollows for liquid, can be drawn [see FIG. 5(*c*) to FIG. 5(*d*)], the shearing action of the gas and the accompanying airstream is single-linearly exerted on each of the spinning liquids, and as a result, generation of droplets can be avoided.

The size of the exit for ejecting gas (Eg) is not particularly limited, but is preferably 0.01 to 79 $mm^2$, more preferably 0.015 to 20 $mm^2$. When the size is less than 0.01 $mm^2$, it tends to become difficult to exert the shearing action on the overall spinning liquid extruded, and therefore, it tends to become difficult to be stably fiberized. When the size is more than 79 $mm^2$, a flow rate sufficient to exert the shearing action on the spinning liquid, that is, a large amount of gas is required, and it is wasteful.

The nozzle for ejecting gas (Ng) may be formed of any material such as a metal or a resin, and a resin or metal tube may be used as the nozzle.

Because the nozzle for ejecting gas (Ng) is arranged so that the exit for ejecting gas (Eg) is located upstream (i.e., at the side where a spinning liquid is supplied) of the first and second exits for extruding liquid ($El_1$, $El_2$), the spinning liquid can be prevented from rising around the first and second exits for extruding liquid ($El_1$, $El_2$). As a result, the exit for extruding liquid is not soiled with the spinning liquid, and spinning may be carried out over a long period. The distance between the exit for ejecting gas (Eg) and each of the first and second exits for extruding liquid ($El_1$, $El_2$) is not particularly limited, but is preferably 10 mm or less, more preferably 5 mm or less. When this distance is more than 10 mm, the shearing action of the gas and the accompanying airstream is not sufficiently exerted on the spinning liquid at the first and second exits for extruding liquid ($El_1$, $El_2$), and it tends to become difficult to be fiberized. The lower limit of the distance between the exit for ejecting gas (Eg) and each of the first and second exits for extruding liquid ($El_1$, $El_2$) is not particularly limited, so long as the exit for ejecting gas (Eg) does not accord with each of the first and second exits for extruding liquid ($El_1$, $El_2$).

In this regard, the distance between the exit for ejecting gas (Eg) and the first exit for extruding liquid ($El_1$) may be the same as, or different from, that between the exit for ejecting gas (Eg) and the second exit for extruding liquid ($El_2$). When this distance is the same, the shearing action can be equally exerted on each spinning liquid to perform stable spinning, and therefore, it is preferable.

The first columnar hollow for liquid ($Hl_1$) and the second columnar hollow for liquid ($Hl_2$) are passages which the spinning liquid flows through, and form the shape of the spinning liquid when extruded. The columnar hollow for gas (Hg) is a passage which the gas flows through, and forms the shape of the gas when ejected. In the present invention, because each of the first and second columnar hollows for liquid ($Hl_1$, $Hl_2$), and the columnar hollow for gas (Hg) can generate a columnar spinning liquid and a columnar gas, respectively, the shearing action of the gas and the accompanying airstream can be sufficiently exerted on each spinning liquid, and each spinning liquid can be fiberized.

The first virtual column for liquid ($Hvl_1$), which is extended from the first columnar hollow for liquid ($Hl_1$), is a flight route of the spinning liquid immediately after being extruded from the first exit for extruding liquid ($El_1$), and the second virtual column for liquid ($Hvl_2$), which is extended from the second columnar hollow for liquid ($Hl_2$), is a flight route of the spinning liquid immediately after being extruded from the second exit for extruding liquid ($El_2$). The virtual column for gas (Hvg), which is extended from the columnar hollow for gas (Hg), is an ejection route of the gas immediately after being ejected from the exit for ejecting gas (Eg). The distance between the first virtual column for liquid ($Hvl_1$) and the virtual column for gas (Hvg) corresponds to the sum of the wall thickness of the first nozzle for extruding liquid ($Nl_1$) and the wall thickness of the nozzle for ejecting gas (Ng), and the distance between the second virtual column for liquid ($Hvl_2$) and the virtual column for gas (Hvg) corresponds to the sum of the wall thickness of the second nozzle for extruding liquid ($Nl_2$) and the wall thickness of the nozzle for ejecting gas (Ng). These distances are preferably 2 mm or less, more preferably 1 mm or less. When the distance is more than 2 mm, the shearing action of the gas and the accompanying airstream is not sufficiently exerted on the spinning liquid, and it tends to become difficult to be fiberized.

The first virtual column for liquid ($Hvl_1$), the second virtual column for liquid ($Hvl_2$), and the virtual column for gas (Hvg) are columns of which the inside is filled. For example, in a case where a cylindrical first or second virtual portion for liquid is covered with a hollow-cylindrical virtual portion for gas (or in a case where a cylindrical virtual portion for gas is covered with a hollow-cylindrical first or second virtual portion for liquid), when the virtual column for gas and the first or second virtual column for liquid are cross-sectioned with a plane perpendicular to the central axis (Ag) of the virtual column for gas (Hvg), there exist an infinite number of straight lines having the shortest distance between the outer boundary of the cross-section of the first or second virtual portion for liquid and the inner boundary of the cross-section of the virtual portion for gas (or between the outer boundary of the cross-section of the virtual portion for gas and the inner boundary of the cross-section of the first or second virtual portion for liquid). Therefore, the shearing action of the gas and the accompanying airstream is exerted on the spinning liquid at various points, and as a result, the spinning liquid is not sufficiently fiberized, and a lot of droplets occur. These "virtual columns" are portions which are extended from the inner walls of the nozzles, respectively.

Because the first central axis of the extruding direction ($Al_1$) of the first columnar hollow for liquid ($Hl_1$) is parallel to the central axis of the ejecting direction (Ag) of the columnar hollow for gas (Hg), and the second central axis of the extruding direction ($Al_2$) of the second columnar hollow for liquid ($Hl_2$) is parallel to the central axis of the ejecting direction (Ag) of the columnar hollow for gas (Hg), the shearing action of the gas and the accompanying airstream can be single-linearly exerted on each of the extruded spinning liquids, and thus, fibers can be stably formed. When these central axes coincide with each other, for example, in a case where a cylindrical first or second hollow portion for liquid is covered with a hollow-cylindrical hollow portion for gas, or in a case where a cylindrical hollow portion for gas is covered with a hollow-cylindrical first or second hollow portion for liquid, the shearing action of the gas and the accompanying airstream cannot be single-linearly exerted on each of the spinning liquids, and as a result, the spinning liquid is not sufficiently fiberized, and a lot of droplets occur. Alternatively, when these central axes are skew, or intersect with each other, the shearing action of the gas and the accompanying airstream is not exerted, or is not uniform if exerted, and thus, each of the spinning liquids is not stably fiberized. The term "parallel" means that the central axis of the extruding direction of the first or second columnar hollow for liquid and the central axis of the ejecting direction of the columnar hollow for gas are coplanar and parallel. The term "the central axis of the extruding (or ejecting) direction" means the line that is bounded by the center of the exit for extruding liquid (or for ejecting gas) and the center of the cross-section of the virtual column for liquid (or for gas).

In the spinning apparatus of the present invention, when the columnar hollow for gas (Hg) and the first and second columnar hollows for liquid ($Hl_1$, $Hl_2$) are cross-sectioned with a plane perpendicular to the central axis (Ag) of the columnar hollow for gas (Hg), only a single straight line (L1) having the shortest distance between the outer boundary of the cross-section of the columnar hollow for gas (Hg) and the outer boundary of the cross-section of the first columnar hollow for liquid ($Hl_1$) can be drawn, and only a single straight line (L2) having the shortest distance between the outer boundary of the cross-section of the columnar hollow for gas (Hg) and the outer boundary of the cross-section of the second columnar hollow for liquid ($Hl_2$) can be drawn. Because the gas ejected from the columnar hollow for gas (Hg) and the accompanying airstream single-linearly act on each of the spinning liquid extruded from the first columnar hollow for liquid ($Hl_1$) and the spinning liquid extruded from the second columnar hollow for liquid ($Hl_2$), the shearing action is single-linearly exerted on each of the spinning liquids to thereby perform stable spinning without generation of droplets. For example, when two straight lines can be drawn, because the shearing action is not stably exerted, for example, on one point and on another point by turns, droplets occur and stable spinning cannot be carried out.

Although not shown in FIG. 4, the first and second nozzles for extruding liquid ($Nl_1$, $Nl_2$) are connected to a reservoir for a spinning liquid (for example, a syringe, a stainless steel tank, a plastic tank, or a bag made of a resin, such as a vinyl chloride resin or a polyethylene resin), and the nozzle for ejecting gas (Ng) is connected to a gas supply equipment (for example, a compressor, a gas cylinder, or a blower).

Although FIG. 4 shows a set of spinning apparatus, two or more sets of spinning apparatus can be arranged. The productivity can be improved by arranging two or more sets of spinning apparatus.

FIG. 4 shows an embodiment in which the first nozzle for extruding liquid (Nl), the second nozzle for extruding liquid ($Nl_2$), and the nozzle for ejecting gas (Ng) are fixed, but the present invention is not limited to this embodiment shown in FIG. 4, so long as these nozzles comply with the relations as described above. Such nozzles may be prepared by, for example, boring a base material having step heights to form the first columnar hollow for liquid ($Hl_1$), the second columnar hollow for liquid ($Hl_2$), and the columnar hollow for gas (Hg). The spinning apparatus may comprises a means capable of freely adjusting the position of the first exit for extruding liquid ($El_1$) of the first nozzle for extruding liquid ($El_1$), the position of the second exit for extruding liquid ($El_2$) of the second nozzle for extruding liquid ($Nl_2$), and/or the position of the exit for ejecting gas (Eg) of the nozzle for ejecting gas (Ng).

The apparatus of the present invention for manufacturing a nonwoven fabric comprises a fibers collection means as well as the spinning apparatus as described above, and thus, a nonwoven fabric can be produced by collecting fibers. Because two or more nozzles for extruding liquid are arranged with respect to one nozzle for ejecting gas in this apparatus, and the amount of the ejected gas can be reduced, the scattering of fibers can be avoided, and a nonwoven fabric having an excellent uniformity can be produced with a high productivity. Further, this apparatus is energy-efficient, because the amount of the gas can be reduced, and a high-capacity suction apparatus is not required.

The fibers collection means may be any support capable of directly accumulating fibers thereon, and the examples as previously described may be used. It is preferable that an air-permeable support is used and a suction apparatus is arranged on the opposite side of the fibers collection means from the spinning apparatus, because of the same reasons as previously described. The fibers collection means may be arranged as previously described.

When the fibers collection means is arranged opposite to the exit for ejecting gas (Eg) of the spinning apparatus, the distance between the fibers collection means and the first and second exits for extruding liquid ($El_1$, $El_2$) of the spinning apparatus varies in accordance with the amount of a spinning liquid extruded or the flow rate of a gas, and is not particularly limited, but is preferably 30 to 1000 mm. When this distance is less than 30 mm, a nonwoven fabric sometimes cannot be obtained, because fibers are accumulated, while the solvent contained in the spinning liquid does not completely evaporate and remains, and the shape of each fiber accumulated cannot be maintained. When this distance is more than 1000 mm, the gas flow is liable to be disturbed, and therefore, the fibers are liable to be broken and scattered.

In addition to the fibers collection means, the apparatus of the present invention for manufacturing a nonwoven fabric preferably comprises a container for spinning capable of containing the spinning apparatus and the fibers collection means, because of the reasons as previously described.

When a nonwoven fabric is produced by using the apparatus of the present invention for manufacturing a nonwoven fabric, the flow rate of the gas ejected from the exit for ejecting gas (Eg) of the spinning apparatus, a method of ejecting the gas, and the type of the gas can be appropriately selected in a similar fashion as previously described.

As previously described, a spinning liquid used in the process of the present invention is not particularly limited, and may be any liquid prepared by dissolving a desired polymer in a solvent. The viscosity of a spinning liquid when spinning is carried out is preferably 10 to 10000 mPa·s, more preferably 20 to 8000 mPa·s, because of the same reasons as previously described. The amount of each spinning liquid extruded from the exit for extruding liquid (El), the first exit for extruding liquid ($El_1$), and the second exit for extruding liquid ($El_2$) is not particularly limited, because it varies depending on the viscosity of each spinning liquid or the flow rate of a gas. It is preferably 0.1 to 100 $cm^3$/hour. In this regard, the amount of a spinning liquid extruded from the first exit for extruding liquid ($El_1$) may be the same as, or different from, that of the second exit for extruding liquid ($El_2$). When the amounts are the same, fibers having a more uniform fiber diameter may be spun.

Another embodiment of the process of the present invention for manufacturing a nonwoven fabric is a process using the apparatus described above, and comprising the steps of extruding one or more spinning liquids from the exits for extruding liquid under two or more different extruding conditions to be fiberized, and accumulating the fiberized fibers on the fibers collection means to produce a nonwoven fabric. In this process, because the extruding conditions of the first nozzle for extruding liquid ($Nl_1$) and the second nozzle for extruding liquid ($Nl_2$) in FIG. 4 are different, and the gas that acts on these extruded spinning liquid is the same, different types of fibers can be spun, and as a result, a nonwoven fabric having an excellent uniformity in which different types of fibers are uniformly mixed can be produced.

The term "two or more different extruding conditions" as used herein means that each condition is not completely the same as the other condition(s), that is, each condition is different from the other condition(s) in one, or two or more conditions selected from, for example, the outer shape of the exit for extruding liquid, the size of the exit for extruding liquid, the distance between the exit for extruding liquid and the exit for ejecting gas, the amount of a spinning liquid extruded, the concentration of a spinning liquid, polymers contained in a spinning liquid, the viscosity of a spinning liquid, solvents contained in a spinning liquid, the ratio of polymers contained in a spinning liquid when the spinning liquid contains two or more polymers, the ratio of solvents contained in a spinning liquid when the spinning liquid contains two or more solvents, the temperature of a spinning liquid, or the type and/or the amount of an additive contained in a spinning liquid. Among these conditions, when a polymer(s) contained in spinning liquids is the same, but the concentrations thereof in the spinning liquids are different, or when a polymer(s) contained in spinning liquids is the same, but solvents contained in the spinning liquids are different, a nonwoven fabric having an excellent uniformity in which two or more types of fibers having different fiber diameters are uniformly mixed can be produced. Alternatively, when polymers contained in spinning liquids are different, a nonwoven fabric having an excellent uniformity in which two or more types of fibers containing different polymers are uniformly mixed can be produced.

EXAMPLES

The present invention now will be further illustrated by, but is by no means limited to, the following Examples.

Example 1

(Preparation of Spinning Liquid)

Polyacrylonitrile (manufactured by Aldrich) was dissolved in N,N-dimethylformamide so as to become a concentration of 10 mass % to prepare a spinning liquid (viscosity (temperature: 25° C.): 970 mPa·s).

(Preparation of Apparatus for Manufacturing Nonwoven Fabric)

A manufacturing apparatus as shown in FIG. 1 comprising the following parts was prepared.

(1) Reservoir for spinning liquid: syringe (2) Air supply equipment: compressor (3) Nozzle for extruding liquid (Nl): metal nozzle (3)-1 Exit for extruding liquid (El): circular, 0.4 mm in diameter (cross-sectional area: 0.13 $mm^2$)

(3)-2 Columnar hollow for liquid (Hl): cylindrical, 0.4 mm in diameter (3)-3 Outer diameter of nozzle: 0.7 mm (3)-4 Number of nozzles: 1

(4) Nozzle for ejecting gas (Ng): metal nozzle (4)-1 Exit for ejecting gas (Eg): circular, 0.4 mm in diameter (cross-sectional area: 0.13 $mm^2$)

(4)-2 Columnar hollow for gas (Hg): Cylindrical, 0.4 mm in diameter (4)-3 Outer diameter of nozzle: 0.7 mm (4)-4 Number of nozzles: 1

(4)-5 Positions: The nozzles were arranged so that the exit for ejecting gas (Eg) was located 5 mm upstream of the exit for extruding liquid (El), and the outer walls of the nozzles were directly contacted with each other.

(5) Distance between virtual column for liquid (Hvl) and virtual column for gas (Hvg): 0.3 mm (6) Central axis of extruding direction of liquid (Al) and central axis of ejecting direction of gas (Ag): parallel (7) Number of straight lines having the shortest distance between the outer boundary of the cross-section of the columnar hollow for gas (Hg) and the outer boundary of the cross-section of the columnar hollow for liquid (Hl) when the columnar hollows are cross-sectioned with a plane perpendicular to the central axis of the columnar hollow for gas (Hg): 1

(8) Fibers collection means: net (30 mesh)

(8)-1 Distance from exit for extruding liquid (El): 300 mm (9) Suction apparatus for fibers: blower

(10) Container for spinning: acrylic case having a volume of 1 $m^3$ (10)-1 Gas supply equipment: precision air generator (manufactured by Apiste, 1400-HDR)

(Manufacture of Nonwoven Fabric)

Fibers were accumulated on the fibers collection means (net) under the following conditions to produce a nonwoven fabric having a mass per unit area of 5 $g/m^2$.

(a) Amount of spinning liquid extruded from nozzle for extruding liquid (Nl): 3 $cm^3$/hour (b) Flow rate of air ejected: 200 m/sec.

(c) Moving speed of net: 0.65 mm/sec.

(d) Conditions for suctioning fibers: 30 cm/sec.

(e) Conditions for supplying gas: 25° C., 27% RH, 1 $m^3$/min.

Comparative Example 1

(Preparation of Spinning Liquid)

The same spinning liquid as that described in Example 1 was prepared.

(Preparation of Apparatus for Manufacturing Nonwoven Fabric)

A manufacturing apparatus comprising the following parts was prepared.

(1) Reservoir for spinning liquid: stainless steel tank (2) Air supply equipment: compressor (3) Nozzle for extruding liquid Nl): metal nozzle (3)-1 Exit for extruding liquid: circular, 0.7 mm in diameter (cross-sectional area: 0.38 $mm^2$)

(3)-2 Columnar hollow for liquid: cylindrical, 0.7 mm in diameter (3)-3 Outer diameter of nozzle: 1.1 mm (3)-4 Number of nozzles: 1

(4) Nozzle for ejecting gas (Ng): metal nozzle (4)-1 Exit for ejecting gas: circular, 2.1 mm in diameter (cross-sectional area: 3.46 $mm^2$)

(4)-2 Columnar hollow for gas: Cylindrical, 2.1 mm in diameter (4)-3 Outer diameter of nozzle: 2.5 mm (4)-4 Number of nozzles: 1

(4)-5 Positions: The nozzles were arranged so that the exit for ejecting gas was located 2 mm upstream of the exit for extruding liquid, and the nozzle for ejecting gas and the nozzle for extruding liquid were concentrically located. As a result, the exit for ejecting gas has an annular shape having an inner diameter of 1.1 mm and an outer diameter of 2.1 mm (see FIG. 3).

(5) Distance between virtual column for liquid and virtual column for gas: 0.4 mm (6) Central axis of extruding direction of liquid and central axis of ejecting direction of gas: coaxial (7) Number of straight lines having the shortest distance between the inner boundary of the cross-section of the columnar hollow for gas and the outer boundary of the cross-section of the columnar hollow for liquid when the columnar hollows are cross-sectioned with a plane perpendicular to the central axis of the columnar hollow for gas: infinite (8) Fibers collection means: net (30 mesh)

(8)-1 Distance from exit for extruding liquid: 300 mm (9) Suction apparatus for fibers: blower

(10) Container for spinning: acrylic case having a volume of 1 $m^3$ (10)-1 Gas supply equipment: precision air generator (manufactured by Apiste, 1400-HDR)

(Manufacture of Nonwoven Fabric)

Spinning was carried out under the following conditions to produce a nonwoven fabric, but almost all of extruded spinning liquids did not have a fibrous form, and a nonwoven fabric was not obtained.

(a) Amount of spinning liquid extruded from nozzle for extruding liquid: 3 $cm^3$/hour (b) Flow rate of air ejected: 200 m/sec.

(c) Moving speed of net: 0.65 mm/sec.

(d) Conditions for suctioning fibers: 30 cm/sec.

(e) Conditions for supplying gas: 25° C., 27% RH, 1 $m^3$/min.

Example 2

(Preparation of Spinning Liquid)

Polyacrylonitrile (manufactured by Aldrich) was dissolved in N,N-dimethylformamide so as to become a concentration of 10.5 mass % to prepare a spinning liquid (viscosity (temperature: 23° C.): 1100 mPa·s).

(Preparation of Apparatus for Manufacturing Nonwoven Fabric)

A manufacturing apparatus as shown in FIG. 4 comprising the following parts was prepared.

(1) Reservoir for spinning liquid: syringe (2) Air supply equipment: compressor (3) First nozzle for extruding liquid ($Nl_1$): metal nozzle (3)-1 First exit for extruding liquid ($El_1$): circular, 0.33 mm in diameter (cross-sectional area: 0.086 $mm^2$)

(3)-2 First columnar hollow for liquid ($Hl_1$): cylindrical, 0.33 mm in diameter (3)-3 Outer diameter of nozzle: 0.64 mm (4) Second nozzle for extruding liquid ($Nl_2$): metal nozzle (4)-1 Second exit for extruding liquid ($El_2$): circular, 0.33 mm in diameter (cross-sectional area: 0.086 $mm^2$)

(4)-2 Second columnar hollow for liquid ($Hl_2$): cylindrical, 0.33 mm in diameter (4)-3 Outer diameter of nozzle: 0.64 mm (5) Nozzle for ejecting gas (Ng): metal nozzle (5)-1 Exit for ejecting gas (Eg): circular, 0.33 mm in diameter (cross-sectional area: 0.086 $mm^2$)

(5)-2 Columnar hollow for gas (Hg): Cylindrical, 0.33 mm in diameter (5)-3 Outer diameter of nozzle: 0.64 mm (5)-4 Positions: The nozzles were arranged so that the exit for ejecting gas (Eg) was located 2 mm upstream of each of the first exit for extruding liquid ($El_1$) and the second exit for extruding liquid ($El_2$), and the outer walls of the nozzles were directly contacted with each other.

(6)-1 Distance between first virtual column for liquid ($Hvl_1$) and virtual column for gas (Hvg): 0.31 mm (6)-2 First central axis of extruding direction of liquid ($Al_1$) and central axis of ejecting direction of gas (Ag): parallel (6)-3 Number of straight lines (L1) having the shortest distance between the outer boundary of the cross-section of the columnar hollow for gas (Hg) and the outer boundary of the cross-section of the first columnar hollow for liquid ($Hl_1$) when the columnar hollows are cross-sectioned with a plane perpendicular to the central axis (Ag) of the columnar hollow for gas (Hg): 1

(7)-1 Distance between second virtual column for liquid ($Hvl_2$) and virtual column for gas (Hvg): 0.31 mm (7)-2 Second central axis of extruding direction of liquid ($Al_2$) and central axis of ejecting direction of gas (Ag): parallel (7)-3 Number of straight lines (L2) having the shortest distance between the outer boundary of the cross-section of the columnar hollow for gas (Hg) and the outer boundary of the cross-section of the second columnar hollow for liquid ($Hl_2$) when the columnar hollows are cross-sectioned with a plane perpendicular to the central axis (Ag) of the columnar hollow for gas (Hg): 1

(8)-1 Fibers collection means: A net (a mesh-type conveyor net of which the surface was coated with a fluororesin) was arranged so that the surface thereof for capturing fibers was perpendicular to the center axis of the extruding direction of each spinning liquid.

(8)-2 Distance between fibers collection means and first and second exits for extruding liquid ($El_1$, $El_2$): 150 mm (9) Suction apparatus: suction box (suction diameter: 50 mm×230 mm)

(10) Container for spinning: acrylic case having a volume of 1 $m^3$ (10)-1 Gas supply equipment: precision air generator (manufactured by Apiste, 1400-HDR)

(10)-2 Exhaust apparatus: fan connected to suction box (suction apparatus)

(Manufacture of Nonwoven Fabric)

Fibers were accumulated on the fibers collection means (net) under the following conditions to produce a nonwoven fabric (average fiber diameter: approximately 300 nm). A nonwoven fabric having an excellent uniformity could be produced without the scattering of fibers and with a high productivity.

(a) Amount of spinning liquid extruded from the first nozzle for extruding liquid ($Nl_1$) and the second nozzle for extruding liquid ($Nl_2$): 3 g/hour (b) Flow rate of air ejected: 250 m/sec.

(c) Amount of air ejected: 1.3 L/min.

(d) Moving speed of net: 30 cm/min.

(e) Conditions for suction of suction box: maximum air volume 18 $m^3$/min. (0.1 kW)

(f) Conditions for supplying gas: air (23° C., 50% RH) was supplied at a flow rate of 200 L/min.

(g) Conditions for exhausting gas: 201.3 L/min. or more

Example 3

(Preparation of Spinning Liquid)

Polyacrylonitrile (manufactured by Aldrich) was dissolved in N,N-dimethylformamide so as to become a concentration of 8 mass % to prepare spinning liquid A (viscosity (temperature: 23° C.): 500 mPa·s).

Further, polyacrylonitrile (manufactured by Aldrich) was dissolved in N,N-dimethylformamide so as to become a concentration of 11 mass % to prepare spinning liquid B (viscosity (temperature: 23° C.): 1600 mPa·s).

(Preparation of Apparatus for Manufacturing Nonwoven Fabric)

The manufacturing apparatus described in Example 2 was prepared.

(Manufacture of Nonwoven Fabric)

Fibers were accumulated on the fibers collection means (net) under the following conditions to produce a nonwoven fabric. A nonwoven fabric having an excellent uniformity could be produced without the scattering of fibers and with a high productivity. Fibers having an average fiber diameter of 0.2 μm and fibers having an average fiber diameter of 0.4 μm were uniformly mixed in the nonwoven fabric.

(a) Extruding condition of the first nozzle for extruding liquid ($Nl_1$): Spinning liquid A was extruded at a rate of 3 g/hour.

(b) Extruding condition of the second nozzle for extruding liquid ($Nl_2$): Spinning liquid B was extruded at a rate of 3 g/hour.

(c) Flow rate of air ejected: 250 m/sec.

(d) Amount of air ejected: 1.3 L/min.

(e) Moving speed of net: 30 cm/min.

(f) Conditions for suction of suction box: maximum air volume 18 $m^3$/min. (0.1 kW)

(g) Conditions for supplying gas: air (23° C., 50% RH) was supplied at a flow rate of 200 L/min.

(h) Conditions for exhausting gas: 201.3 L/min. or more

Example 4

(Preparation of Spinning Liquid)

Polyacrylonitrile (manufactured by Aldrich) was dissolved in N,N-dimethylformamide so as to become a concentration of 8 mass % to prepare spinning liquid C (viscosity (temperature: 23° C.): 500 mPa·s).

Further, a PVDF (polyvinylidene fluoride) copolymer (manufactured by Arkema) was dissolved in N,N-dimethylformamide so as to become a concentration of 20 mass % to prepare spinning liquid D (viscosity (temperature: 23° C.): 680 mPa·s).

(Preparation of Apparatus for Manufacturing Nonwoven Fabric)

The manufacturing apparatus described in Example 2 was prepared.

(Manufacture of Nonwoven Fabric)

Fibers were accumulated on the fibers collection means (net) under the following conditions to produce a nonwoven fabric. A nonwoven fabric having an excellent uniformity could be produced without the scattering of fibers and with a high productivity. Acrylic fibers having an average fiber diameter of 0.2 μm and PVDF fibers having an average fiber diameter of 0.2 μm were uniformly mixed in the nonwoven fabric.

(a) Extruding condition of the first nozzle for extruding liquid ($Nl_1$): Spinning liquid C was extruded at a rate of 3 g/hour.
(b) Extruding condition of the second nozzle for extruding liquid ($Nl_2$): Spinning liquid D was extruded at a rate of 3 g/hour.
(c) Flow rate of air ejected: 250 m/sec.
(d) Amount of air ejected: 1.3 L/min.
(e) Moving speed of net: 30 cm/min.
(f) Conditions for suction of suction box: maximum air volume 18 $m^3$/min. (0.1 kW)
(g) Conditions for supplying gas: air (23° C., 50% RH) was supplied at a flow rate of 200 L/min.
(h) Conditions for exhausting gas: 201.3 L/min. or more Example 5

(Preparation of Spinning Liquid)

Polyacrylonitrile (manufactured by Aldrich) was dissolved in N,N-dimethylformamide so as to become a concentration of 8 mass % to prepare spinning liquid E (viscosity (temperature: 23° C.): 500 mPa·s).

Further, polyacrylonitrile (manufactured by Aldrich) was dissolved in dimethyl sulfoxide so as to become a concentration of 8 mass % to prepare spinning liquid F (viscosity (temperature: 23° C.): 1800 mPa·s).

(Preparation of Apparatus for Manufacturing Nonwoven Fabric)

The manufacturing apparatus described in Example 2 was prepared.

(Manufacture of Nonwoven Fabric)

Fibers were accumulated on the fibers collection means (net) under the following conditions to produce a nonwoven fabric. A nonwoven fabric having an excellent uniformity could be produced without the scattering of fibers and with a high productivity. Acrylic fibers having an average fiber diameter of 0.2 μm and acrylic fibers having an average fiber diameter of 0.4 μm were uniformly mixed in the nonwoven fabric.

(a) Extruding condition of the first nozzle for extruding liquid ($Nl_1$): Spinning liquid E was extruded at a rate of 3 g/hour.
(b) Extruding condition of the second nozzle for extruding liquid ($Nl_2$): Spinning liquid F was extruded at a rate of 3 g/hour.
(c) Flow rate of air ejected: 250 m/sec.
(d) Amount of air ejected: 1.3 L/min.
(e) Moving speed of net: 30 cm/min.
(f) Conditions for suction of suction box: maximum air volume 18 $m^3$/min. (0.1 kW)
(g) Conditions for supplying gas: air (23° C., 50% RH) was supplied at a flow rate of 200 L/min.
(h) Conditions for exhausting gas: 201.3 L/min. or more

REFERENCE SIGNS LIST

Nl, $Nl_n$: Nozzle for extruding liquid
$Nl_1$: First nozzle for extruding liquid
$Nl_2$: Second nozzle for extruding liquid
Ng: Nozzle for ejecting gas
El: Exit for extruding liquid
$El_1$: First exit for extruding liquid
$El_2$: Second exit for extruding liquid
Eg: Exit for ejecting gas
Hl: Columnar hollow for liquid
$Hl_1$: First columnar hollow for liquid
$Hl_2$: Second columnar hollow for liquid
Hg: Columnar hollow for gas
Hvl: Virtual column for liquid
$Hvl_1$: First virtual column for liquid
$Hvl_2$: Second virtual column for liquid
Hvg: Virtual column for gas
Al: Central axis of the extruding direction (liquid)
$Al_1$: First central axis of the extruding direction (liquid)
$Al_2$: Second central axis of the extruding direction (liquid)
Ag: Central axis of the ejecting direction (gas)
C: Plane perpendicular to the central axis of the columnar hollow for gas
$L_1$: Straight line having the shortest distance between outer boundaries
L1: straight line
L2: straight line
12: First member
22: Second member
32: Third member
14, 24, 34: Supply end
16, 26, 36: Opposing exit end
18: First supply slit
38: First gas slit
20: Gas jet space

The invention claimed is:

1. A spinning apparatus comprising one or more exits for extruding liquid, which are capable of extruding a spinning liquid, and an exit for ejecting gas, which is located upstream of each of the exits for extruding liquid and is capable of ejecting a gas, wherein (1) the spinning apparatus comprises a columnar hollow for liquid Hl), in which the exit for extruding liquid forms one end of the columnar hollow for liquid,
(2) the spinning apparatus comprises a columnar hollow for gas (Hg) of which one end is the exit for ejecting gas,
(3) a virtual column for liquid (Hvl) which is extended from the columnar hollow for liquid (Hl) is located adjacent to a virtual column for gas (Hvg) which is extended from the columnar hollow for gas (Hg),
(4) a central axis of an extruding direction in the columnar hollow for liquid (Hl) is parallel to a central axis of an ejecting direction in the columnar hollow for gas (Hg), and (5) when the columnar hollow for gas and the columnar hollow for liquid are cross-sectioned with a plane perpendicular to the central axis of the columnar hollow for gas, there exists only one straight line having the shortest distance between an outer boundary of the cross-section of the columnar hollow for gas (Hg) and an outer boundary of the cross-section of the columnar hollow for liquid (Hl).

2. The spinning apparatus according to claim 1, wherein the spinning apparatus has one exit for extruding liquid.

3. An apparatus for manufacturing a nonwoven fabric, comprising the spinning apparatus according to claim 2 and a fibers collection means.

4. A process for manufacturing a nonwoven fabric comprising the steps of:

extruding a spinning liquid from a spinning apparatus for manufacturing a nonwoven fabric, wherein the spinning liquid is fiberized as fibers; and accumulating the fiberized fibers on a fibers collection means to obtain a nonwoven fabric, wherein said spinning apparatus comprising one or more exits for extruding liquid, the one or more exits for extruding liquid are capable of extruding the spinning liquid, and an exit for ejecting gas, the exit for ejecting gas is located upstream of each of the exits for extruding liquid and is capable of ejecting a gas, wherein (1) the spinning apparatus comprises a columnar hollow for liquid (Hl), wherein one of the one or more exits for extruding liquid forms one end of the columnar hollow for liquid, (2) the spinning apparatus comprises a columnar hollow for gas (Hg), wherein one end of the columnar hollow for gas is the exit for ejecting gas, (3) a virtual column for liquid (Hvl) which is extended from the columnar hollow for liquid (Hl) is located adjacent to a virtual column for gas (Hvg) which is extended from the columnar hollow for gas (H), (4) a central axis of an extruding direction in the columnar hollow for liquid (Hl) is parallel to a central axis of an ejecting direction in the columnar hollow for gas (Hg), (5) when the columnar hollow for gas and the columnar hollow for liquid are cross-sectioned with a plane perpendicular to the central axis of the columnar hollow for gas, there exists only one straight line having a shortest distance between an outer boundary of the cross-section of the columnar hollow for gas (Hg) and an outer boundary of the cross-section of the columnar hollow for liquid (Hl), and (6) a gas having a flow rate of 100 m/sec. or more is ejected from the exit for ejecting gas of the spinning apparatus.

5. A spinning apparatus comprising two or more exits for extruding liquid, the two or more exits for extruding liquid are capable of extruding a spinning liquid, and an exit for ejecting gas, the exit for ejecting gas is located upstream of each of the two or more exits for extruding liquid and is capable of ejecting a gas, wherein (1) the spinning apparatus comprises columnar hollows for liquid, in which each of the two or more exits for extruding liquid forms one end of the corresponding columnar hollow for liquid, (2) the spinning apparatus comprises a columnar hollow for gas of which one end is the exit for ejecting gas, (3) a virtual column for liquid extends from each of the columnar hollows for liquid, each virtual column for liquid is located adjacent to a virtual column for gas which is extended from the columnar hollow for gas, (4) each central axis of an extruding direction in each of the columnar hollows for liquid is parallel to a central axis of an ejecting direction in the columnar hollow for gas, and (5) when the columnar hollow for gas and the columnar hollows for liquid are cross-sectioned with a plane perpendicular to the central axis of the columnar hollow for gas, there exists only one straight line having a shortest distance between an outer boundary of the cross-section of the columnar hollow for gas and an outer boundary of the cross-section of each of the columnar hollows for liquid, at any combination of the columnar hollow for gas and each of the columnar hollows for liquid.

6. The spinning apparatus according to claim 5, wherein an outer shape of each exit for extruding liquid is circular.

7. The spinning apparatus according to claim 5, wherein an outer shape of the exit for ejecting gas is circular.

8. An apparatus for manufacturing a nonwoven fabric, comprising the spinning apparatus according to claim 5 and a fibers collection means.

9. A process for manufacturing a nonwoven fabric comprising the steps of:

extruding a spinning liquid from a spinning apparatus for manufacturing a nonwoven fabric, wherein the spinning liquid is fiberized as fibers; and accumulating the fiberized fibers on a fibers collection means to obtain a nonwoven fabric, wherein said spinning apparatus comprising two or more exits for extruding liquid, the two or more exits for extruding liquid are capable of extruding the spinning liquid, and an exit for ejecting gas, the exit for ejecting gas is located upstream of each of the two or more exits for extruding liquid and is capable of ejecting a gas, wherein (1) the spinning apparatus comprises columnar hollows for liquid, in which each of the two or more exits for extruding liquid forms one end of a corresponding columnar hollow for liquid, (2) the spinning apparatus comprises a columnar hollow for gas, wherein one end of the column hollow for gas is the exit for ejecting gas, (3) a virtual column for liquid extends from each of the columnar hollows for liquid, each virtual column for liquid is located adjacent to a virtual column for gas which extends from the columnar hollow for gas, (4) each central axis of an extruding direction in each of the columnar hollows for liquid is parallel to a central axis of an ejecting direction in the columnar hollow for gas, (5) when the columnar hollow for gas and the columnar hollows for liquid are cross-sectioned with a plane perpendicular to the central axis of the columnar hollow for gas, there exists only one straight line having a shortest distance between an outer boundary of the cross-section of the columnar hollow for gas and an outer boundary of the cross-section of each of the columnar hollows for liquid, at any combination of the columnar hollow for gas and each of the columnar hollows for liquid, and (6) the spinning liquid is extruded from the exits for extruding liquid under two or more different extruding conditions.

10. The process according to claim 9, wherein two or more types of spinning liquids different in concentration are extruded.

11. The process according to claim 9, wherein two or more types of spinning liquids containing different polymers are extruded.

12. The process according to claim 9, wherein two or more types of spinning liquids containing different solvents are extruded.

* * * * *

UNITED STATES PATENT AND TRADEMARK OFFICE

CERTIFICATE OF CORRECTION

PATENT NO. : 7,951,313 B2
APPLICATION NO. : 12/473019
DATED : May 31, 2011
INVENTOR(S) : Matsubayashi et al.

It is certified that error appears in the above-identified patent and that said Letters Patent is hereby corrected as shown below:

Claim 1, at Column 26, Line 56: Delete "for liquid H1)," and insert --for liquid (H1),--

Signed and Sealed this
Nineteenth Day of July, 2011

David J. Kappos

David J. Kappos
*Director of the United States Patent and Trademark Office*